US012281810B2

(12) United States Patent
Joo et al.

(10) Patent No.: US 12,281,810 B2
(45) Date of Patent: Apr. 22, 2025

(54) AIR CONDITIONER AND CONTROLLING METHOD THEREFOR

(71) Applicant: SAMSUNG ELECTRONICS CO., LTD., Suwon-si (KR)

(72) Inventors: Youngju Joo, Suwon-si (KR); Jun Hwang, Suwon-si (KR); Kwangil Nam, Suwon-si (KR); Jeonguk Park, Suwon-si (KR); Hyeongjoon Seo, Suwon-si (KR); Sangwoo Lee, Suwon-si (KR); Hyoshin Lee, Suwon-si (KR); Hyeongkyu Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 159 days.

(21) Appl. No.: 17/665,765

(22) Filed: Feb. 7, 2022

(65) Prior Publication Data

US 2022/0154957 A1 May 19, 2022

Related U.S. Application Data

(63) Continuation of application No. PCT/KR2019/017941, filed on Dec. 18, 2019.

(30) Foreign Application Priority Data

Aug. 14, 2019 (KR) ..... 10-2019-0099880

(51) Int. Cl.
*F24F 11/526* (2018.01)
*F24F 11/38* (2018.01)
(Continued)

(52) U.S. Cl.
CPC ..... *F24F 11/526* (2018.01); *F24F 11/38* (2018.01); *F24F 11/46* (2018.01); *F24F 11/64* (2018.01); *F24F 2110/12* (2018.01)

(58) Field of Classification Search
CPC ..... F24F 11/526; F24F 11/38; F24F 11/46; F24F 11/64; F24F 2110/12; F24F 2110/10; F24F 11/63; F24F 11/523; F24F 11/61
See application file for complete search history.

(56) References Cited

U.S. PATENT DOCUMENTS 9,995,502 B1 * 6/2018 Reeder ..... G05B 15/02
11,796,205 B2 * 10/2023 Venne ..... G06N 20/00
(Continued)

FOREIGN PATENT DOCUMENTS

CN 106123240 A * 11/2016
CN 109520082 A 3/2019
(Continued)

OTHER PUBLICATIONS

Xu English Translation (Year: 2024).*
(Continued)

*Primary Examiner* — Nelson J Nieves
*Assistant Examiner* — Matthew John Moscola
(74) *Attorney, Agent, or Firm* — STAAS & HALSEY LLP

(57) ABSTRACT

An air conditioner which comprises: a temperature sensor; and a processor that obtains, based on receiving a turn-on command for the air conditioner, a first temperature value sensed through the temperature sensor; based on a threshold time elapsing subsequent to the receiving of the turn-on command, obtains a second temperature value sensed through the temperature sensor; and provides notification information related to an environment in which the air conditioner is installed, on the basis of the first temperature value and the second temperature value.

15 Claims, 27 Drawing Sheets

(51) Int. Cl.

| | |
|---|---|
| ***F24F 11/46*** | (2018.01) |
| ***F24F 11/64*** | (2018.01) |
| ***F24F 110/12*** | (2018.01) |

(56) References Cited

U.S. PATENT DOCUMENTS

| | | | | |
|---|---|---|---|---|
| 2014/0262134 | A1 | 9/2014 | Arensmeier et al. | |
| 2016/0047566 | A1* | 2/2016 | Haga | H04Q 9/00 702/182 |
| 2017/0102153 | A1* | 4/2017 | O'Hayer | F24F 11/89 |
| 2018/0172305 | A1* | 6/2018 | Son | F24F 11/30 |
| 2019/0101303 | A1 | 4/2019 | Kaliyaperumal et al. | |
| 2020/0049364 | A1* | 2/2020 | Nakamura | F24F 11/38 |
| 2020/0200417 | A1* | 6/2020 | Wacker | F24F 11/38 |
| 2021/0055026 | A1* | 2/2021 | Kim | F25B 49/005 |
| 2021/0071923 | A1* | 3/2021 | An | F24F 11/61 |
| 2021/0095881 | A1* | 4/2021 | Lian | F24F 11/77 |
| 2021/0199360 | A1* | 7/2021 | Watanabe | F24F 11/36 |
| 2021/0293430 | A1* | 9/2021 | Yamada | F24F 11/86 |
| 2022/0205662 | A1* | 6/2022 | Ishimura | F25B 13/00 |

FOREIGN PATENT DOCUMENTS

| | | | |
|---|---|---|---|
| EP | 2 960 588 | A2 | 12/2015 |
| JP | 4854457 | B2 | 1/2012 |
| JP | 5749612 | B2 | 7/2015 |
| KR | 2002-0096422 | A | 12/2002 |
| KR | 10-2013-0061390 | A | 6/2013 |
| KR | 10-2015-0017628 | A | 2/2015 |
| KR | 10-2015-0084551 | A | 7/2015 |
| KR | 10-1590343 | B1 | 2/2016 |
| KR | 101919824 | B1 * | 7/2017 |
| KR | 10-2018-0003891 | A | 1/2018 |
| KR | 10-2018-0112585 | A | 10/2018 |

OTHER PUBLICATIONS

Woo English Translation (Year: 2024).*

International Search Report for International Patent Application No. PCT/KR2019/017941 dated May 13, 2020.

International Written Opinion for International Patent Application No. PCT/KR2019/017941 dated May 13, 2020.

Extended European Search Report dated Sep. 26, 2022 in European Patent Application No. 19941166.1 (11 pages).

Office Action dated Sep. 15, 2023 in European Patent Application No. 19 941 166.1.

Office Action dated Sep. 14, 2023 in Korean Patent Application No. 10-2019-0099880.

Examination Report dated Jan. 15, 2025 for European Patent Application No. 19941166.1.

* cited by examiner

FIG. 11

1105

| GROUP | INITIAL TEMPERATURE(℃) | REFERENCE COOLING RATE INCLINATION VALUE (TEMPERATURE CHANGE VALUE PER MINUTE) |
|---|---|---|
| 1 | BELOW 21 | 0.08 |
| 2 | 22~25 | 0.11 |
| 3 | 26~29 | 0.17 |
| 4 | 30~33 | 0.22 |
| 5 | 34~37 | 0.27 |
| 6 | 38~41 | 0.38 |
| 7 | over 42 | 0.40 |

<REFERENCE COOLING RATE ACCORDING TO INITIAL TEMPERATURE>

FIG. 12

1205

| GROUP | INITIAL TEMPERATURE(℃) | OUTDOOR UNIT REFERENCE TEMPERATURE (TEMPERATURE AFTER THRESHOLD TIME) |
|---|---|---|
| 1 | BELOW 21 | 27 |
| 2 | 22~25 | 28 |
| 3 | 26~29 | 32 |
| 4 | 30~33 | 34 |
| 5 | 34~37 | 38 |
| 6 | 38~41 | 43 |
| 7 | over 42 | 47 |

<OUTDOOR UNIT REFERENCE TEMPERATURE ACCORDING TO INITIAL TEMPERATURE>

<CHANGE IN INDOOR UNIT TEMPERATURE >

<CHANGE IN INDOOR UNIT TEMPERATURE>

FIG. 15
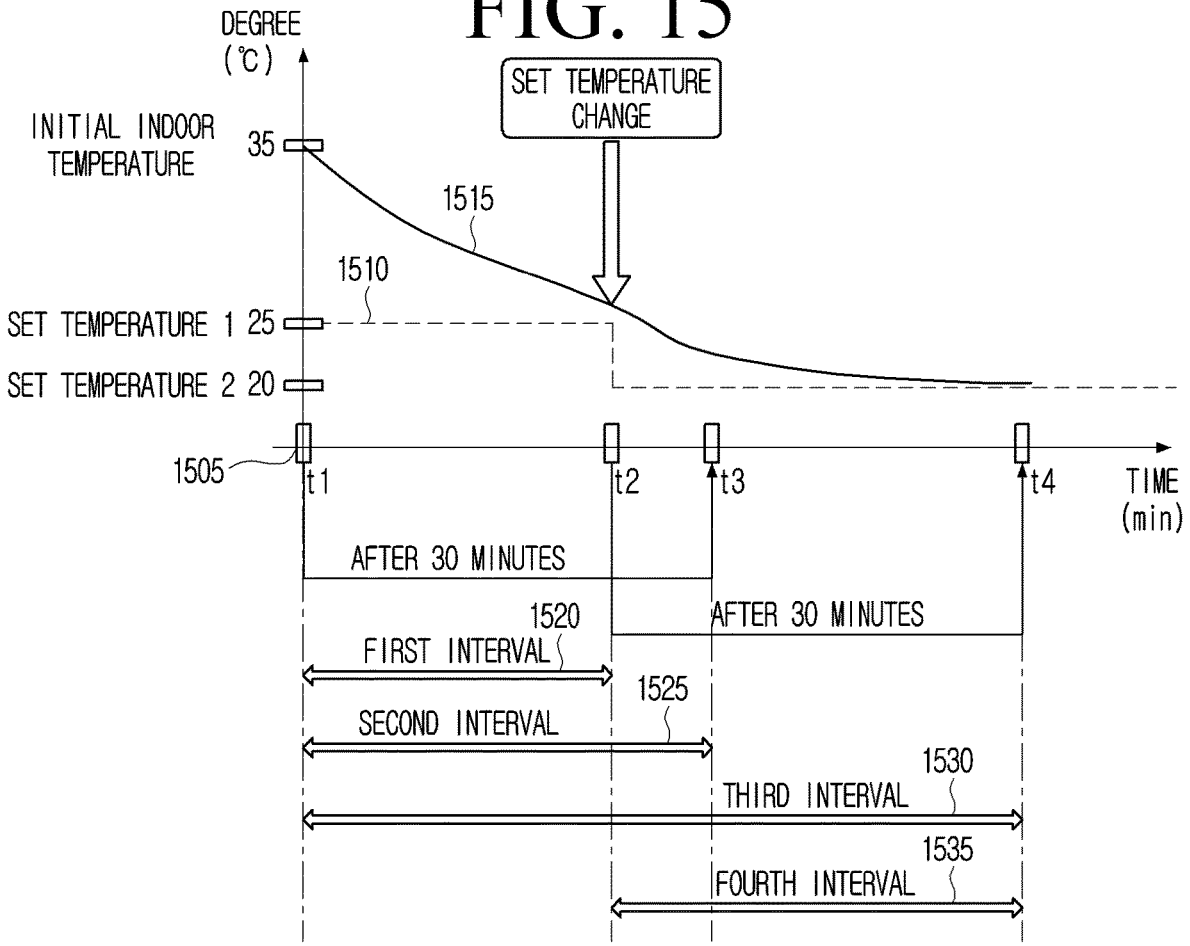
<CHANGE IN INDOOR UNIT TEMPERATURE>
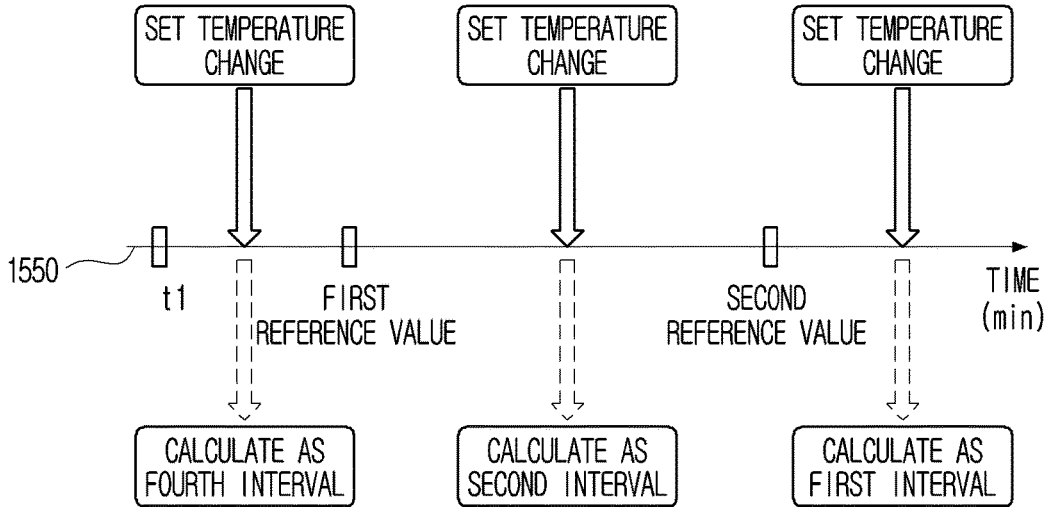
<CALCULATION INTERVAL ACCORDING TO TIME OF SET TEMPERATURE CHANGE>

FIG. 16
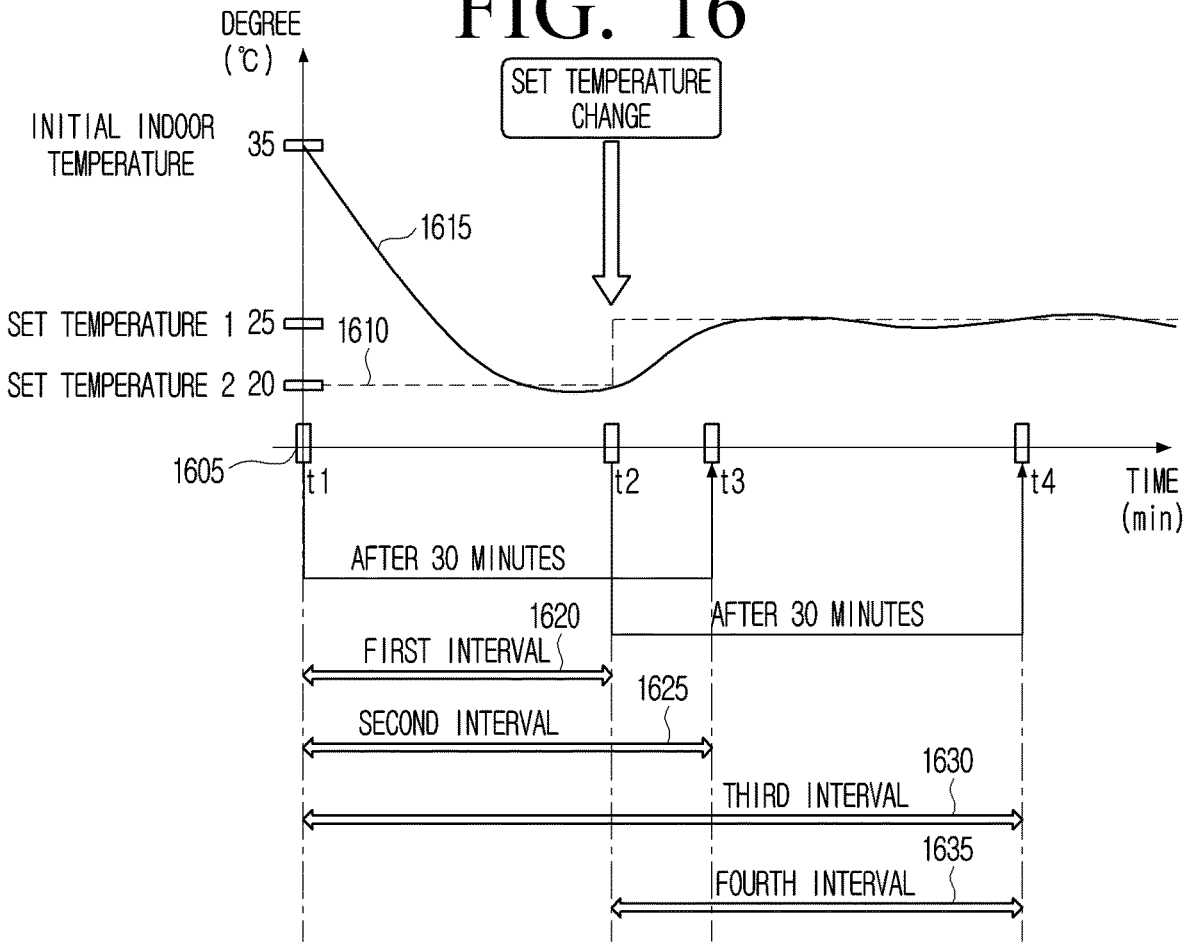
<CHANGE IN INDOOR UNIT TEMPERATURE>
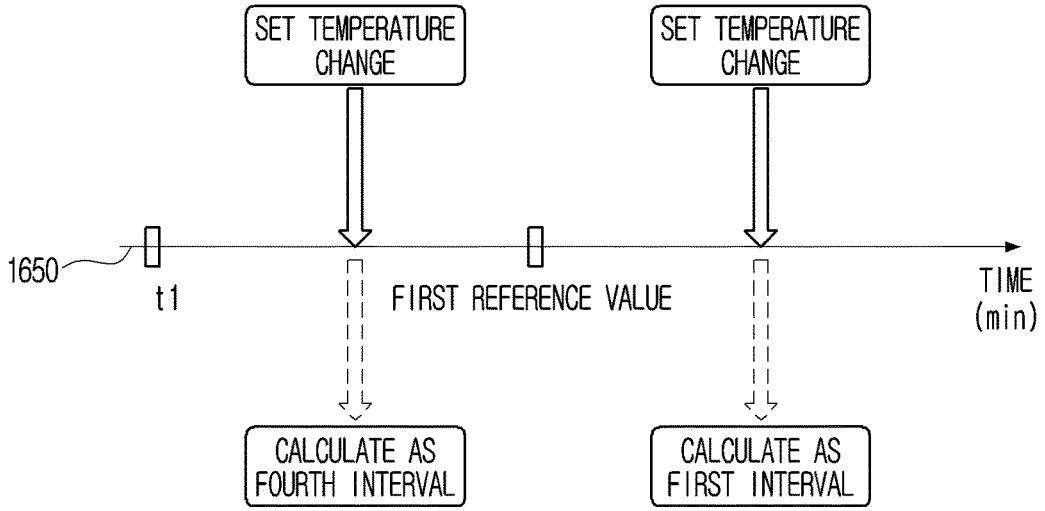
<CALCULATION INTERVAL ACCORDING TO TIME OF SET TEMPERATURE CHANGE >

<OUTDOOR UNIT TEMPERATURE CHANGE >

FIG. 20

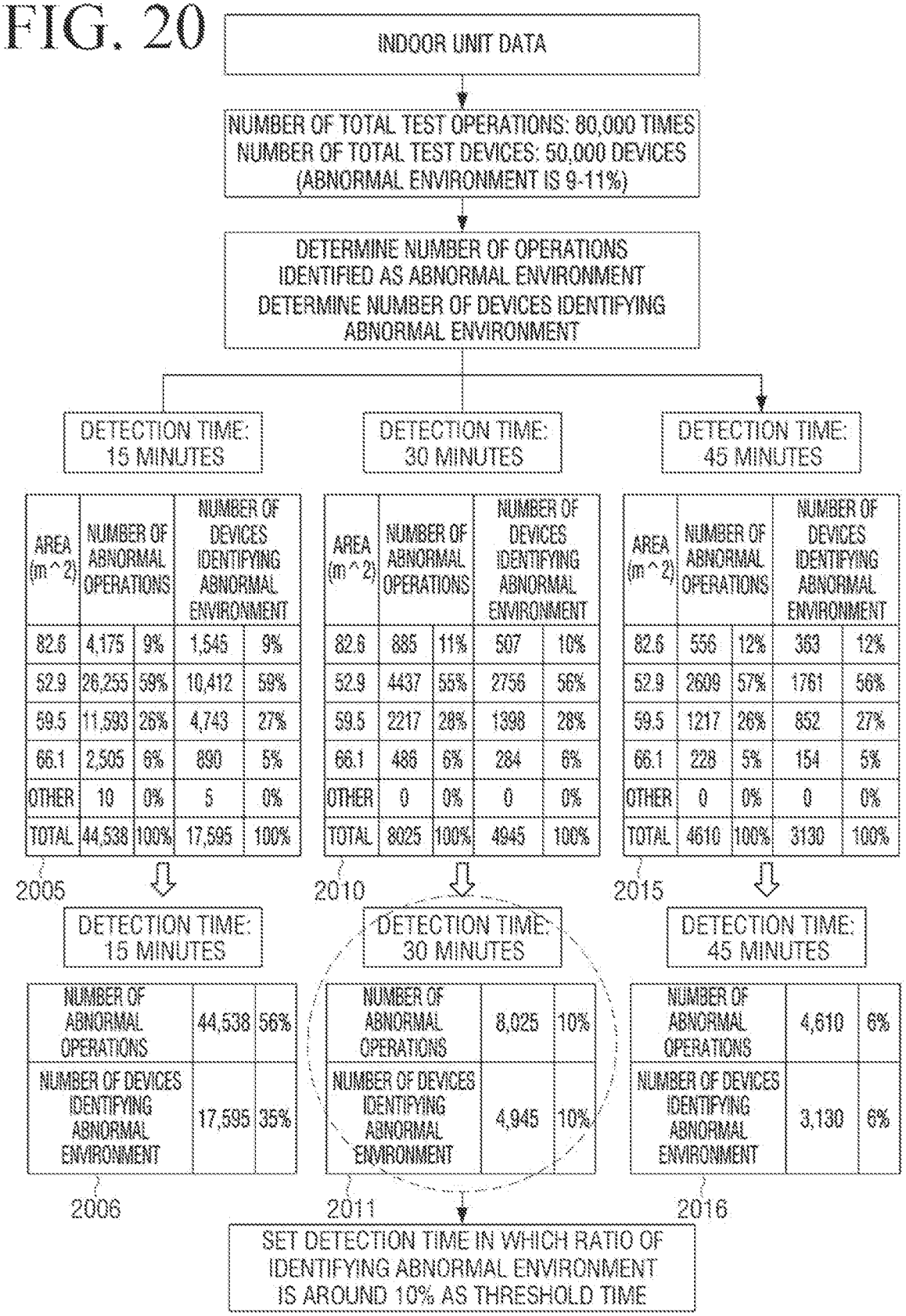

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 4,175 | 9% | 1,545 | 9% |
| 52.9 | 26,255 | 59% | 10,412 | 59% |
| 59.5 | 11,593 | 26% | 4,743 | 27% |
| 66.1 | 2,505 | 6% | 890 | 5% |
| OTHER | 10 | 0% | 5 | 0% |
| TOTAL | 44,538 | 100% | 17,595 | 100% |

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 885 | 11% | 507 | 10% |
| 52.9 | 4437 | 55% | 2756 | 56% |
| 59.5 | 2217 | 28% | 1398 | 28% |
| 66.1 | 486 | 6% | 284 | 6% |
| OTHER | 0 | 0% | 0 | 0% |
| TOTAL | 8025 | 100% | 4945 | 100% |

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 556 | 12% | 363 | 12% |
| 52.9 | 2609 | 57% | 1761 | 56% |
| 59.5 | 1217 | 26% | 852 | 27% |
| 66.1 | 228 | 5% | 154 | 5% |
| OTHER | 0 | 0% | 0 | 0% |
| TOTAL | 4610 | 100% | 3130 | 100% |

| | | |
|---|---|---|
| NUMBER OF ABNORMAL OPERATIONS | 44,538 | 56% |
| NUMBER OF DEVICES IDENTIFYING ABNORMAL ENVIRONMENT | 17,595 | 35% |

| | | |
|---|---|---|
| NUMBER OF ABNORMAL OPERATIONS | 8,025 | 10% |
| NUMBER OF DEVICES IDENTIFYING ABNORMAL ENVIRONMENT | 4,945 | 10% |

| | | |
|---|---|---|
| NUMBER OF ABNORMAL OPERATIONS | 4,610 | 6% |
| NUMBER OF DEVICES IDENTIFYING ABNORMAL ENVIRONMENT | 3,130 | 6% |

FIG. 21

OUTDOOR UNIT DATA

NUMBER OF TOTAL TEST OPERATIONS: 80,000 TIMES
NUMBER OF TOTAL TEST DEVICES: 50,000 DEVICES
(ABNORMAL ENVIRONMENT IS 9-11%)

DETERMINE NUMBER OF OPERATIONS IDENTIFIED AS ABNORMAL ENVIRONMENT
DETERMINE NUMBER OF DEVICES IDENTIFYING ABNORMAL ENVIRONMENT

DETECTION TIME: 15 MINUTES

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 2148 | 13% | 476 | 12% |
| 52.9 | 7486 | 45% | 1903 | 47% |
| 59.5 | 6624 | 39% | 1544 | 38% |
| 66.1 | 512 | 3% | 150 | 4% |
| OTHER | 0 | 0% | 0 | 0% |
| TOTAL | 16770 | 100% | 4073 | 100% |

2105

DETECTION TIME: 30 MINUTES

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 1628 | 13% | 419 | 12% |
| 52.9 | 5556 | 45% | 1593 | 46% |
| 59.5 | 4785 | 39% | 1300 | 38% |
| 66.1 | 438 | 4% | 137 | 4% |
| OTHER | 0 | 0% | 0 | 0% |
| TOTAL | 12407 | 100% | 3449 | 100% |

2110

DETECTION TIME: 45 MINUTES

| AREA (m^2) | NUMBER OF ABNORMAL OPERATIONS | | NUMBER OF DEVICES IDENTIFYING ABNORMAL ENVIRONMENT | |
|---|---|---|---|---|
| 82.6 | 1257 | 14% | 363 | 13% |
| 52.9 | 3951 | 45% | 1283 | 46% |
| 59.5 | 3299 | 37% | 1036 | 37% |
| 66.1 | 334 | 4% | 112 | 4% |
| OTHER | 0 | 0% | 0 | 0% |
| TOTAL | 8841 | 100% | 2794 | 100% |

2115

DETECTION TIME: 15 MINUTES

| | | |
|---|---|---|
| NUMBER OF ABNORMAL OPERATIONS | 16770 | 21% |
| NUMBER OF DEVICES IDENTIFYING ABNORMAL ENVIRONMENT | 4073 | 8% |

2106

DETECTION TIME: 30 MINUTES

| | | |
|---|---|---|
| NUMBER OF ABNORMAL OPERATIONS | 12407 | 16% |
| NUMBER OF DEVICES IDENTIFYING ABNORMAL ENVIRONMENT | 3449 | 7% |

2111

DETECTION TIME: 45 MINUTES

| | | |
|---|---|---|
| NUMBER OF ABNORMAL OPERATIONS | 8841 | 11% |
| NUMBER OF DEVICES IDENTIFYING ABNORMAL ENVIRONMENT | 2749 | 5% |

2116

SET DETECTION TIME IN WHICH ABNORMAL ENVIRONMENT OCCURS MOST AS THRESHOLD TIME

| NUMBER OF LEARNING | 1 | 2 | 3 | 4 | 5 | 6 |
|---|---|---|---|---|---|---|
| INITIAL INDOOR TEMPERATURE | 35 | 35 | 35 | 35 | 35 | 35 |
| INDOOR TEMPERATURE AFTER 30 MINUTES | 26 | 26 | 26 | 26 | 26 | 34 |
| COOLING RATE | 0.3 | 0.3 | 0.3 | 0.3 | 0.3 | 0.03 |
| LEARNING TABLE VALUE | 0.17 | 0.2 | 0.23 | 0.25 | 0.26 | 0.27 |
| DETECTION REFERENCE CONSTANT | 0.21 | 0.21 | 0.21 | 0.21 | 0.21 | 0.21 |
| REFERENCE VALUE | 0.01 | 0.01 | 0.02 | 0.04 | 0.05 | 0.06 |
| DETERMINATION RESULT | NORMAL | NORMAL | NORMAL | NORMAL | NORMAL | ABNORMAL |
| LEARNING VALUE | 0.2 | 0.23 | 0.25 | 0.26 | 0.27 | 0.27 |

| NUMBER OF LEARNING | 1 | 2 | 3 | 4 | 5 | 6 |
|---|---|---|---|---|---|---|
| INITIAL INDOOR TEMPERATURE | 35 | 35 | 35 | 35 | 35 | 35 |
| INDOOR TEMPERATURE AFTER 30 MINUTES | 34 | 34 | 34 | 34 | 34 | 35 |
| COOLING RATE | 0.03 | 0.03 | 0.03 | 0.03 | 0.03 | 0 |
| LEARNING TABLE VALUE | 0.17 | 0.14 | 0.11 | 0.09 | 0.08 | 0.07 |
| DETECTION REFERENCE CONSTANT | 0.21 | 0.21 | 0.21 | 0.21 | 0.21 | 0.21 |
| REFERENCE VALUE | 0.01 | 0.01 | 0.01 | 0.01 | 0.01 | 0.01 |
| DETERMINATION RESULT | NORMAL | NORMAL | NORMAL | NORMAL | NORMAL | ABNORMAL |
| LEARNING VALUE | 0.14 | 0.11 | 0.09 | 0.08 | 0.07 | 0.07 |

AIR CONDITIONER AND CONTROLLING METHOD THEREFOR

CROSS-REFERENCE TO RELATED APPLICATIONS

This application is a continuation application, under 35 U.S.C. § 111(a), of International Patent Application No. PCT/KR2019/017941, filed on Dec. 18, 2019, which claims the claims benefit of priority to Korean Patent Application No. 10-2019-0099880, filed on Aug. 14, 2019, in the Korean Intellectual Property Office, the disclosure of which is incorporated by reference herein in its entirety.

BACKGROUND

1. Field

This disclosure relates to an air conditioner and a control method therefor and, more particularly to, an air conditioner for providing notification related to an environment in which the air conditioner is installed and a control method therefor.

2. Description of Related Art

A use of an air conditioner is increasing to keep a space pleasant in summer. In Korea, the use of air conditioners is concentrated on summer, so services to handle failure (or malfunction), product consultation and maintenance are concentrated for a certain period of time. Especially in the summer, a lot of expenses are spent to inform an alternative measure to user complaints.

A user of an air conditioner may have dissatisfaction due to a failure of a product itself, an installation defect generated in an installation process of an air conditioner product, lack of understanding of an environment of product installation, lack of understanding of a product itself, or the like.

A related-art air conditioner may diagnose the failure of the product using the self-diagnosis function with the hardware components of the air conditioner itself, and a service engineer or a service consultant may provide a service using an error code. For example, whether a product has failed may be determined through a digital signal such as a motor, a compressor, and a sensor, or the like, and an error code corresponding to a failure is displayed.

In the related-art, a user of a product may confirm the error code, and may confirm the information of the error code through a user manual or a home page of a corresponding manufacturer. The related-art may not teach an abnormal portion and solution plan for the environment in which the product is installed. Accordingly, there is a problem in that a service engineer needs to directly visit a place where a product is installed, thereby generating an economic loss to the manufacturer.

There may be a case in which performance of the air conditioner is deteriorated due to an environment in which the product is installed.

For example, when an indoor unit is operated in a state where an indoor window is opened, the indoor temperature may not fall to the set temperature even if the indoor unit operates normally. In this example, the air conditioner continues to operate and a lot of power of the air conditioner may be consumed.

For example, an outdoor unit may be operated in a state where a window of an air-conditioning plant room is closed. Due to the environment of the air-conditioning plant room, a ventilation defect may be generated and performance degradation of a product due to the same may be generated. In addition, the ventilation defect may deteriorate the efficiency of the product, and thus the performance and efficiency of the product may not be maintained.

However, there is a problem that it is difficult to determine a problem with the environment in which the product is installed, not the failure of the product itself. If there is a problem with the environment in which the product is installed, the customer center may not readily know the information about the environment in which the product is installed, making it difficult to provide an accurate solution.

SUMMARY

An air conditioner includes a temperature sensor and a processor configured to, based on receiving a turn-on command for the air conditioner, obtain a first temperature value sensed through the temperature sensor, based on a threshold time elapsing subsequent to the receiving of the turn-on command, obtain a second temperature value sensed through the temperature sensor, and provide notification information related to an environment in which the air conditioner is installed based on the first temperature value and the second temperature value.

The air conditioner may further include a memory to store information about a reference cooling rate by initial temperatures, and the processor may identify a current cooling rate corresponding to the threshold time based on the first temperature value and the second temperature value, identify a reference cooling rate corresponding to the first temperature value based on information stored in the memory, and provide notification information related to an environment in which an indoor unit is installed based on the current cooling rate, the reference cooling rate, and a set temperature value at the threshold time.

The temperature sensor may be included in an outdoor unit, and the processor may, based on a difference between the first temperature value and the second temperature value at the threshold time being greater than or equal to a third reference value, provide notification information related to the environment in which the outdoor unit is installed.

The air conditioner may further include a memory to store information about a reference temperature of an outdoor unit by initial temperatures, and the processor may provide notification information related to an environment in which the outdoor unit is installed based on a difference between the reference temperature of the outdoor unit corresponding to the first temperature value and the second temperature value.

The air conditioner may further include a compressor, and the processor may provide notification information related to the environment in which the air conditioner is installed based on the first temperature value, the second temperature value, and a frequency of the compressor.

The temperature sensor is a first temperature sensor included in the indoor unit and a second temperature sensor included in an outdoor unit, and the method for controlling the air conditioner may further include, based on identifying that the environment in which the outdoor unit is installed does not satisfy a preset condition based on the first temperature value and the second temperature value obtained through the second temperature sensor, providing notification information related to the environment in which the outdoor unit is installed where no notification information related to the environment in which the indoor unit is installed is provided.

A first threshold time corresponding to the first temperature sensor may be longer than a second threshold time corresponding to the second temperature sensor.

The air conditioner may further include a speaker, and the processor may control the speaker to provide the notification information related to the environment as voice.

The air conditioner may further include a communication interface, and the processor may control the communication interface to provide the notification information related to the environment to an external device.

A method of controlling an air conditioner according to an embodiment includes, based on receiving a turn-on command for the air conditioner, obtaining a first temperature value sensed through a temperature sensor, based on a threshold time elapsing subsequent to the receiving of the turn-on command, obtaining a second temperature value sensed through the temperature sensor, and providing notification information related to an environment in which the air conditioner is installed based on the first temperature value and the second temperature value.

The method for controlling an air conditioner includes storing information about a reference cooling rate by initial temperatures and may include identifying a current cooling rate corresponding to the threshold time based on the first temperature value and the second temperature value and identifying a reference cooling rate corresponding to the first temperature value based on the stored information. The providing the notification information may include providing notification information related to an environment in which the indoor unit is installed based on the current cooling rate, the reference cooling rate, and a set temperature value at the threshold time.

The temperature sensor may be a temperature sensor included in the outdoor unit, and the providing the notification information may include, based on a difference between the first temperature value and the second temperature value at the threshold time being greater than or equal to a third reference value, providing notification information related to the environment in which the outdoor unit is installed.

The temperature sensor may be a temperature sensor included in the outdoor unit, and the providing the notification information may include, based on a difference between the first temperature value and the second temperature value at the threshold time being greater than or equal to a third reference value, providing notification information related to the environment in which the outdoor unit is installed.

The providing the notification information may include providing notification information related to the environment in which the air conditioner is installed based on the first temperature value, the second temperature value, and a frequency of the compressor.

The temperature sensor may be a first temperature sensor included in the indoor unit and a second temperature sensor is included in an outdoor unit, and the method for controlling the air conditioner may further include, based on identifying that the environment in which the outdoor unit is installed does not satisfy a preset condition based on the first temperature value and the second temperature value obtained through the second temperature sensor, providing notification information related to the environment in which the outdoor unit is installed where no notification information related to the environment in which the indoor unit is installed is provided.

A first threshold time corresponding to the first temperature sensor may be longer than a second threshold time corresponding to the second temperature sensor.

The providing the notification information may further include controlling a speaker to provide notification information related to the environment as voice.

The providing the notification information may include controlling the communication interface to provide notification information related to the environment to an external device.

BRIEF DESCRIPTION OF THE DRAWINGS

The above and/or other aspects of the disclosure will be more apparent by describing certain embodiments of the disclosure with reference to the accompanying drawings, in which:

FIG. 11 is a diagram illustrating a reference cooling rate associated with indoor temperature;

FIG. 12 is a table illustrating reference temperature associated with an outdoor unit;

FIG. 15 is a diagram illustrating still another embodiment of detecting an abnormal environment according to temperature change of an indoor unit;

FIG. 16 is a diagram illustrating still another embodiment of detecting an abnormal environment according to temperature change of an indoor unit;

FIG. 20 is a diagram illustrating an operation of determining a threshold time corresponding to an indoor unit;

FIG. 21 is a diagram illustrating an operation of determining a threshold time corresponding to an outdoor unit;

DETAILED DESCRIPTION

Figure 1:
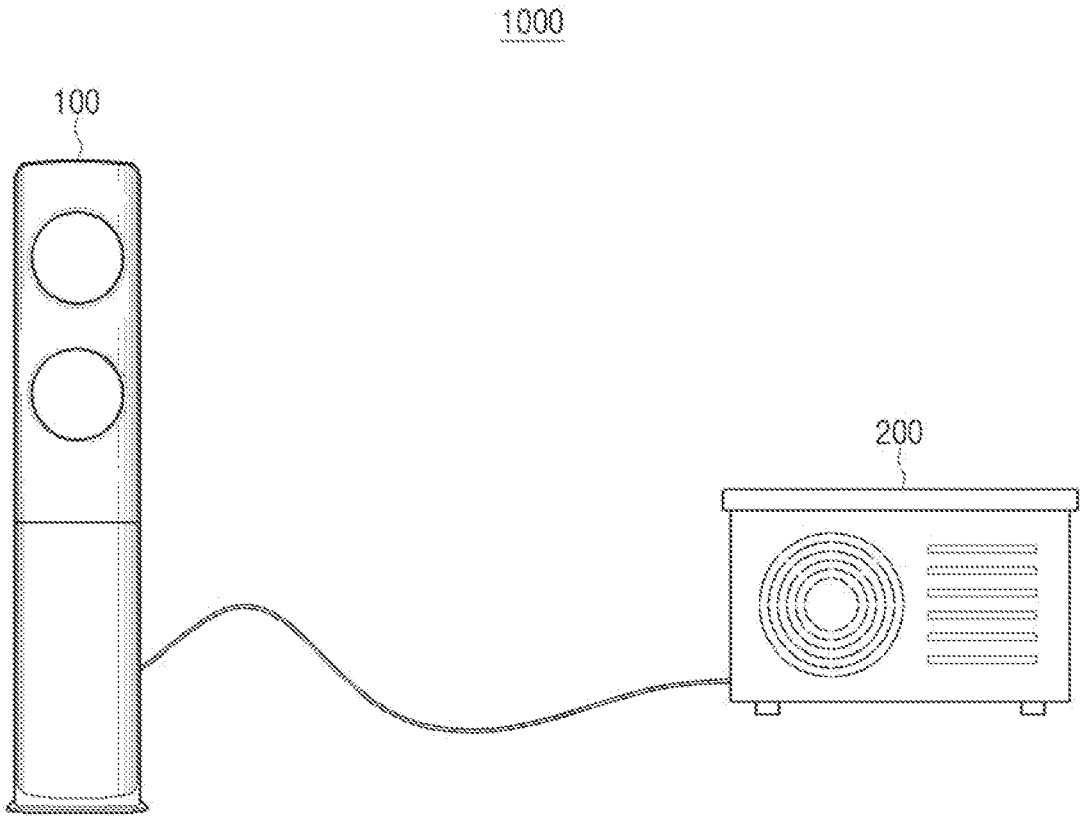
FIG. 1 is a block diagram illustrating an air conditioner according to an embodiment of the disclosure.

The disclosure will be described in greater detail with reference to the attached drawings.

The terms used in the disclosure and the claims are general terms identified in consideration of the functions of embodiments of the disclosure. However, these terms may vary depending on intention, legal or technical interpretation, emergence of new technologies, and the like of those skilled in the related art. In addition, in some cases, a term may be arbitrarily selected, in which case the term will be described in detail in the description of the corresponding disclosure. Thus, the term used in this disclosure should be defined based on the meaning of term, not a simple name of the term, and the contents throughout this disclosure.

Expressions such as "have," "may have," "include," "may include" or the like represent presence of corresponding numbers, functions, operations, or parts, and do not exclude the presence of additional features.

Expressions such as "at least one of A or B" and "at least one of A and B" should be understood to represent "A," "B" or "A and B."

As used herein, terms such as "first," and "second," may identify corresponding components, regardless of order and/or importance, and are used to distinguish a component from another without limiting the components.

In addition, a description that one element (e.g., a first element) is operatively or communicatively coupled with/to" or "connected to" another element (e.g., a second element) should be interpreted to include both the first element being directly coupled to the second element, and the first element being indirectly coupled to the second element through an intervening third element.

A singular expression includes a plural expression, unless otherwise specified. It is to be understood that terms such as "comprise" or "consist of" are used herein to designate a presence of a characteristic, number, step, operation, element, component, or a combination thereof, and not to preclude a presence or a possibility of adding one or more of other characteristics, numbers, steps, operations, elements, components or a combination thereof.

A term such as "module," "unit," and "part," is used to refer to an element that performs at least one function or operation and that may be implemented as hardware or software, or a combination of hardware and software. Except when each of a plurality of "modules," "units," "parts," and the like must be realized in an individual hardware, the components may be integrated in at least one module or chip and be realized in at least one processor.

In the following description, a "user" may refer to a person using an electronic apparatus or an artificial intelligence electronic apparatus using an electronic apparatus (e.g., artificial intelligence electronic apparatus).

The disclosure relates to an air conditioner that provides notification information related to an environment in which the air conditioner is installed based on a temperature value obtained from a temperature sensor included in the air conditioner and a control method therefor.

Hereinafter, various example embodiments of the disclosure will be described in greater detail.

FIG. 1 is a block diagram illustrating an air conditioner according to an embodiment of the disclosure.

Referring to FIG. 1, an air conditioner 1000 may include an indoor unit 100 and an outdoor unit 200.

The air conditioner 1000 performs an operation for conditioning indoor air. The air conditioner 1000 may be a cooling device that lowers the temperature of the indoor air according to an embodiment. According to another embodiment, the air conditioner 1000 may perform at least one air conditioning of heating to increase temperature of indoor air, ventilating to form air current indoors, and dehumidifying indoor humidity.

The air conditioner 1000 may include an outdoor unit 200 for exchanging heat with external air by using a refrigerant, and an indoor unit 100 for exchanging a refrigerant with the outdoor unit 200 for performing an air conditioning operation of the indoor air.

The indoor unit 100 may include an indoor heat exchanger receiving a refrigerant and exchanging heat with indoor air. The indoor unit 100 may include an indoor fan for forcibly discharging indoor air by an indoor fan motor to exchange heat in an indoor heat exchanger. A detailed configuration of the indoor unit 100 will be described later with reference to FIG. 3.

The outdoor unit 200 may include a compressor compressing the refrigerant into a gaseous state at high temperature and high pressure. The outdoor unit 200 may include an outdoor heat exchanger that receives a compressed high temperature high pressure gas refrigerant from the compressor and heat-exchanges with outdoor air. The outdoor unit 200 may include an outdoor fan that forces the air to be ventilated by an outdoor fan motor so that heat exchange is performed in the outdoor heat exchanger. The specific configuration of the outdoor unit 200 is described later in FIG. 3.

According to an embodiment, the outdoor unit 200 may be installed in an outdoor space. Meanwhile, according to another embodiment, the outdoor unit 200 may be installed in an indoor space. The outdoor unit 200 may be arranged in an indoor space of an air-conditioning plant room.

Figure 2:
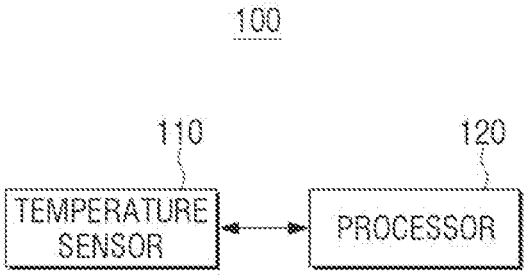
FIG. 2 is a block diagram illustrating an indoor unit according to an embodiment of the disclosure.

FIG. 2 is a block diagram illustrating an air conditioner 1000 according to an embodiment of the disclosure.

Referring to FIG. 2, the indoor unit 100 may include a temperature sensor 110 and a processor 120.

The temperature sensor 110 may sense the temperature of the indoor space. The temperature sensor 110 may measure an indoor temperature of a space in which the indoor unit 100 is disposed based on a control command of the processor 120. The temperature sensor 110 may be installed at a place where the temperature of the indoor air may be sensed.

The processor 120 may control overall operations of the processor 120. The processor 120 may control overall operations of the indoor unit 100.

The processor 120 may be implemented as a digital signal processor (DSP), a microprocessor, and a time controller (TCON) for processing a digital image signal, but is not limited thereto. The processor 120 may include one or more among a central processing unit (CPU), a micro controller unit (MCU), a micro processing unit (MPU), a controller, an application processor (AP), a graphics-processing unit (GPU), a communication processor (CP), and an Advanced Reduced instruction set computing (RISC) Machine (ARM) processor or may be defined as a corresponding term. The processor 120 may be implemented in a system on chip (SoC) type or a large scale integration (LSI) type which a processing algorithm is built therein or in a field programmable gate array (FPGA) type. The processor 120 may perform various functions by executing computer executable instructions stored in a memory 130.

The processor 120 may analyze the ambient environment of the place where the air conditioner 1000 is installed. A place where the air conditioner 1000 is installed may refer to each place in which the indoor unit 100 or the outdoor unit 200 is installed. A place where the air conditioner 1000 is installed may refer to a place where the indoor unit 100 is installed and a place where the outdoor unit 200 is installed.

The environment refers to various situations affecting the air conditioner 1000. For example, the environment may mean a physical situation such as temperature, humidity, an open (or closed) state of a window included in the indoor space, an open (or closed) state of the window included in the air-conditioning plant room.

An operation of analyzing an ambient environment may mean that the vicinity of a place (or space) where the air conditioner 1000 is installed is in which environment (state), and determines whether the ambient environment is a normal environment or an abnormal environment.

The normal environment may refer to an environment in which the air conditioner 1000 may operate efficiently. In order to efficiently operate the air conditioner 1000, the indoor space in which the indoor unit 100 is installed should not be introduced with external air and the air discharged from the outdoor unit 200 should not be discharged to the outside. Therefore, the normal environment may refer to a state where the window of the place where the indoor unit 100 is installed is closed or air discharged from the outdoor unit may not be discharged to the outside.

The abnormal environment may mean that the ambient environment of the place where the air conditioner 1000 is installed is not a normal environment. The abnormal environment may be in a state where an indoor space is not airtight (or hermetic) in a place where the air conditioner 1000 is installed, or air discharged from the outdoor unit 200 cannot be discharged to the outside. The abnormal environment may be divided into an abnormal environment of a space in which the indoor unit 100 is installed and an abnormal environment of a space in which the outdoor unit 200 is installed.

For example, when the window is opened in the space where the indoor unit 100 is installed, hot air outside the window may continue to flow into the room. Accordingly, even though the indoor unit 100 performs a cooling operation for a long time, the indoor temperature may not fall down to the set temperature. If the window is closed (in the case of a normal environment) the indoor temperature will fall to the set temperature. The abnormal environment of the indoor unit 100 may refer to a situation where the indoor temperature does not fall normally. The abnormal environment of the indoor unit 100 may be any one of an indoor unit curtain clogging, an indoor filter clogging, an indoor window opening, and an indoor visit opening.

For example, when the outdoor unit 200 is installed in the air-conditioning plant room, if the outdoor unit 200 is operated in a state in which the window of the air-conditioning plant room is not opened, the temperature of the air-conditioning plant room may increase, since hot air may not be discharged to the outside. When the temperature of the air-conditioning plant room rises, the product failure of the outdoor unit 200 may be caused. When the window of the air-conditioning plant room is closed, the temperature of the air-conditioning plant room may be increased. Accordingly, an abnormal environment of the outdoor unit 200 may refer to a situation where the outdoor unit temperature is higher than a reference temperature. The abnormal environment of the outdoor unit 200 may be any one of a ventilation failure of the outdoor unit 200 and an air-conditioning plant room gallery clogging.

The processor 120 may determine the abnormal environment of the indoor unit 100 or the abnormal environment of the outdoor unit 200. The abnormal environment of the indoor unit 100 will be described first.

The processor 120 may determine the abnormal environment of the indoor unit 100 based on at least one of the set temperature, measured temperature, reference cooling rate.

The set temperature may mean the temperature considered to control the output of the cooling function of the air conditioner 1000. If the set temperature is high, the output of the cooling function may be weak, and if the set temperature is low, the output of the cooling function may be strong. According to an embodiment, the setting temperature may be received by a user input. According to another embodiment, the set temperature may be temperature that is stored in the memory lastly when performing the previous cooling operation. The set temperature may be divided into an initial set temperature and set temperature at a time when a threshold time has elapsed. The embodiment in which the set temperature is changed will be described in detail with reference to FIGS. 15 and 16.

The measured temperature may mean temperature measured by the temperature sensor of the indoor unit. The measured temperature may be divided into first temperature (initial temperature, temperature at the time of receiving a turn-on command) and second temperature (temperature at the time of detecting abnormal environment). The time when measuring the first temperature may mean the time when the turn-on command is received by the air conditioner 1000. The time when the second temperature is measured may mean the time when a threshold time has elapsed after receiving the turn-on command by the air conditioner 1000.

The threshold time may refer to a time when cooling is performed sufficiently.

For example, the threshold time may be a preset value. The threshold time may refer to a value obtained based on average data (or weighted-average data) of average cooling time obtained through sample data. As another example, the threshold time may be a learned value. The learned value may refer to data obtained based on usage data (history data) after installation of the air conditioner 1000. The processor 120 may measure the time during which the indoor temperature falls from the first temperature at the time of measuring to the set temperature, and the processor 120 may determine the threshold time based on an average value of the usage data (history data).

The reference cooling rate may be a value indicating how much the indoor temperature would fall during the threshold time. The reference cooling rate may have another value at the initial temperature. The air conditioner 1000 may obtain expected temperature based on the reference cooling rate. The expected temperature may refer to how much is the indoor temperature at a specific time.

According to an embodiment, the reference cooling rate may be a predetermined value. The predetermined value may mean a predefined value that applies to the product by the manufacturer. The predetermined value may be a value obtained based on sample data and average data in a test environment. The predetermined value may vary depending on the type of the air conditioner 1000 or the installation position. The reference cooling rate may be already stored in memory at the time of release of the product.

According to another embodiment, the reference cooling rate may mean the learned value. The learned value may mean the data obtained based on the usage data (historical data) after the installation of the air conditioner 1000. If the user operates the air conditioner 1000 repeatedly, the usage data (historical data) may be stored in memory for the number of repetitions. The usage data (historical data) may mean the temperature data from the time the user enters the turn-on command into the air conditioner 1000 to the time the turn-off command is entered into the air conditioner 1000 after the threshold time has elapsed.

According to another embodiment, there may be two types of reference cooling rates. The first reference cooling rate is a preset value and the second reference cooling rate may be a learned value. The processor 120 may determine an abnormal environment based on at least one of the first standard cooling rate or the second reference cooling rate according to the embodiment.

The processor 120 may perform an abnormal environment determination operation only when a specific condition (a precondition to determine an abnormal environment) is satisfied.

When the difference value between the set temperature and the first temperature is equal to or greater than the reference value, the processor 120 may determine whether the ambient environment of the space in which the indoor unit 100 is installed is an abnormal environment. The set temperature may be less than or equal to first temperature. For example, it is assumed reference value 3, first temperature 30, and set temperature 28. Since the difference between the reference value and the first temperature is 2, the reference value is smaller than the reference value 3. Accordingly, the processor 120 may not perform an abnormal environment determination operation. For another example, it is assumed reference value 3, first temperature 30, and set temperature 25. Since the difference between the reference value and the first temperature is 5, the reference value corresponds to 3 or more. Accordingly, the processor 120 may perform an abnormal environment determination operation.

When the first temperature is equal to or greater than the reference value, the processor 120 may determine whether the ambient environment of the space in which the indoor unit 100 is installed is an abnormal environment. For example, it is assumed reference value 26 and first temperature 24. Since the first temperature is less than the reference value, the processor 120 may not determine an abnormal environment. For another example, it is assumed reference value 26 and first temperature 26. Since the first temperature corresponds to a reference value or more, the processor 120 may determine an abnormal environment.

When at least one condition among various conditions is satisfied, the processor 120 may identify the ambient environment (hereinafter, current environment) of the space where the indoor unit 100 is installed as an abnormal environment.

According to the first condition among various conditions, if the difference between the first and second temperatures is below or equal to the reference value, the processor 120 may identify the current environment as an abnormal environment. The second temperature may be less than or equal to the first temperature. For example, it is assumed reference value 2, first temperature 30, and second temperature 29. Since the difference value 1 of the first temperature and the second temperature is less than or equal to reference value 2, the processor 120 may identify the current environment as an abnormal environment. For another example, it is assumed reference value 2, first temperature 30, and second temperature 27. The difference between the first temperature and the second temperature value 3 is greater than the reference value 2, so the processor 120 may identify the current environment as a normal environment.

If the current cooling rate is less than 50% of the reference cooling rate, depending on the second condition among the various conditions, the processor 120 may identify the current environment as an abnormal environment. The reference cooling rate may be a value corresponding to the first temperature. The current cooling rate may be a value obtained by dividing the difference value between the first temperature and the second temperature by time. The second temperature may be less than or equal to the first temperature. For example, it is assumed a current cooling rate 0.1 and a reference cooling rate 0.26. Since 50% of the reference cooling rate is 0.13 and the current cooling rate is less than 50% of the reference cooling rate, the processor 120 may identify the current environment as an abnormal environment. For another example, it is assumed a current cooling rate 0.3, a reference cooling rate 0.26. Since 50% of the reference cooling rate is 0.13 and the current cooling rate is greater than or equal to 50% of the reference cooling rate, the processor 120 may identify the current environment as a normal environment.

If the difference between the current cooling rate and the reference cooling rate is equal to or greater than the reference value according to the third condition among the various conditions, the processor 120 may identify the current environment as an abnormal environment. For example, it is assumed a reference value 0.1, a current cooling rate 0.1, and reference cooling rate of 0.27. Since the difference value 0.17 of the current cooling rate and the reference cooling rate is greater than or equal to reference value 0.1, the processor 120 may identify the current environment as an abnormal environment. For another example, it is assumed a reference value 0.1, a current cooling rate 0.3, and a reference cooling rate 0.27. Since the difference value 0.03 between the current cooling rate and the reference cooling rate is less than or equal to 0.1, the processor 120 may identify the current environment as a normal environment. Another embodiment of identifying an abnormal environment using the difference between the current cooling rate and the reference cooling rate will be described later in FIG. 24.

According to fourth condition among the various conditions, if the compressor frequency at the time of abnormal environmental detection timing is greater than or equal to the reference value, the processor 120 may identify the current environment as an abnormal environment, where the unit of compressor frequency may be Hz. For example, it is assumed the reference value 58, compressor frequency 60 at the time of abnormal environmental detection. Since the compressor frequency at the time of abnormal environmental detection is greater than the reference value, the processor 120 may identify the current environment as an abnormal environment. As another example, it is assumed a reference value 58, a compressor frequency 55 at the time of abnormal environmental detection. Since the compressor frequency at the time of abnormal environmental detection is less than the reference value, the processor 120 may identify the current environment as a normal environment.

According to a fifth condition among various conditions, if the difference value between the set temperature and the second temperature is greater than or equal to the reference value, the processor 120 may identify the current environment as an abnormal environment. For example, it is assumed a reference value 3, a set temperature 24, and a second temperature 28. Since the difference value between the set temperature and the second temperature is greater than or equal to 3, the processor 120 may identify the current environment as an abnormal environment. For another example, it is assumed a reference value 3, a set temperature 24, and a second temperature 25. Since the difference value 1 between the set temperature and the second temperature is less than or equal to the reference value, the processor 120 may identify the current environment as a normal environment.

When at least one of the various conditions described above is satisfied, the processor 120 may identify the environment of the indoor unit 100 as an abnormal environment. The reference values described above have the same name but do not mean all the same numbers. The reference values used in each condition may not be the same. Each reference value may be different depending on the set temperature or the first temperature (initial temperature).

The first to fifth conditions described above refer to conditions related to the indoor unit, and the first temperature and the second temperature may be obtained from the indoor unit temperature sensor and the current environment may mean an ambient environment of the indoor unit. As described above, the processor 120 may analyze the ambient environment of the outdoor unit 200 in addition to the ambient environment of the indoor unit 100. In order to avoid confusion, the terms an outdoor unit first temperature, an outdoor unit second temperature, and an outdoor unit ambient environment will be used.

If the processor 120 satisfies at least one of various conditions, the processor 120 may identify an ambient environment of a space in which the outdoor unit 200 is installed (hereinafter, referred to as an outdoor unit current environment) as an abnormal environment.

The processor 120 may receive the outdoor unit first temperature (the time when the turn-on command is received) and the outdoor unit second temperature (a threshold time has passed after the turn-on command has been received) from the outdoor unit temperature sensor. The processor 120 may determine whether an ambient environment in which the outdoor unit 200 is installed is an abnormal environment based on at least one of a first temperature of the outdoor unit, a second temperature of the outdoor unit, or a reference temperature of the outdoor unit.

The reference temperature of the outdoor unit may refer to the estimated temperature of the outdoor u nit at the time when a threshold time has passed after the air conditioner 1000 receives a turn-on command. The reference temperature of the outdoor unit may be different in accordance with the temperature (outdoor unit first temperature) of the initial timing.

According to an embodiment, the reference temperature of the outdoor unit may be a preset value. The preset value may mean a predefined value applicable to a product by a manufacturer. The preset value may be a value obtained based on sample data and average data in the test environment. The preset value may be different according to a type or installation location of the air conditioner 1000. The reference temperature of the outdoor unit may have been stored in a memory at the time of product release.

According to another embodiment, the reference temperature of the outdoor unit may mean a learned value. The learned value may mean data obtained based on usage data (history data) after installation of the air conditioner 1000. If the user repeatedly operates the air conditioner 1000, the usage data (history data) may be stored in the memory by the repetition times. The usage data (history data) may mean temperature data from the time when the user inputs the turn-on command to the air conditioner 1000, and until the user inputs the turn-off command to the air conditioner 1000.

According to still another embodiment, a type of the reference temperature of the outdoor unit may be two. The reference temperature of the first outdoor unit may be a predetermined value and the reference temperature of the second outdoor unit may be a learned value. The processor 120 may determine an abnormal environment based on at least one of a reference temperature of the first outdoor unit or a reference temperature of the second outdoor unit according to an embodiment.

When the processor 120 satisfies at least one condition among various conditions, the processor 120 may identify an ambient environment (hereinafter, referred to as a current environment) of the space in which the outdoor unit 200 is installed as an abnormal environment.

If the difference between the first temperature of the outdoor unit and the second temperature of the outdoor unit is equal to or greater than the reference value according to the first condition among the various conditions, the processor 120 may identify that the ambient environment of the outdoor unit 200 is abnormal. For example, it is assumed a reference value 5, a first temperature 30, and a second temperature 40. Since the difference value 10 between the first temperature of the outdoor unit and the second temperature of the outdoor unit is greater than the reference value 5, the processor 120 may identify the current environment of the outdoor unit in an abnormal state. For example, it is assumed a reference value 5, a first temperature 30, and a second temperature 33. Since the difference value 3 between the first temperature of the outdoor unit and the second temperature of the outdoor unit is less than the reference value 5, the processor 120 can identify the current environment of the outdoor unit as normal.

If the difference between the second temperature of the outdoor unit and the reference temperature of the outdoor unit is equal to or greater than the reference value, the processor 120 may identify that the ambient environment of the outdoor unit 200 is abnormal. For example, it is assumed that the reference value is 3, the outdoor unit second temperature 40, and the outdoor unit reference temperature 33. Since the difference value 7 between the second temperature of the outdoor unit and the reference temperature of the outdoor unit is greater than the reference value, the processor 120 may identify that the ambient environment of the outdoor unit is abnormal. For example, it is assumed that the reference value is 3, the outdoor unit second temperature 35, and the outdoor unit reference temperature 33. Since the difference value 2 between the second temperature of the outdoor unit and the reference temperature of the outdoor unit is lower than the reference value, the processor 120 may identify that the ambient environment of the outdoor unit is normal. In the above example, it has been assumed that the outdoor unit reference temperature is constant regardless of the initial temperature (the outdoor unit first temperature). If the outdoor unit reference temperature is different according to the initial temperature, an operation considering the set temperature in the second condition may be added.

It has been described various conditions for determining whether the ambient environment of the indoor unit 100 and the outdoor unit 200 is abnormal. The processor 120 may identify whether the ambient environment of the air conditioner 1000 is abnormal by integrating the above conditions. If the ambient environment of the air conditioner 1000 is abnormal, the notification information may be provided. The ambient environment of the air conditioner 1000 may be at least one of an ambient environment of the indoor unit 100 or an ambient environment of the outdoor unit 200. The processor 120 may use a first temperature value and a second temperature value to identify an abnormal environment.

When a turn-on command for the air conditioner 1000 is received, the processor 120 may obtain the first temperature value at the time when the turn-on command is received through the temperature sensor. When a turn-on command for the air conditioner 1000 is received, the processor 120 may obtain a first temperature value at a time when a turn-on command is received through the temperature sensor. When the threshold time elapses at the time when the turn-on command is received, the second temperature value may be obtained at the time when the threshold time passes through the temperature sensor. The first temperature is the temperature measured at the time at which the turn-on command is received (the initial time) and the second temperature is the temperature measured at the time (the abnormal environment detection time) after the turn-on command has been received.

The turn-on command may be a command to control the air conditioner 1000 to perform a cooling function. The threshold time may be a predetermined value or a value determined by the usage data (history data) of the air conditioner 1000. The threshold time may be determined differently for the indoor unit 100 and the outdoor unit 200. For example, the threshold time of the outdoor unit 200 may be 15 minutes and the threshold time of the indoor unit 100 may be 30 minutes. However, it is not necessary that the threshold time of the indoor unit 100 and the outdoor unit 200 are different, and in some cases, the air conditioner 1000 may have the same threshold time.

The air conditioner 1000 may include a plurality of temperature sensors. The air conditioner 1000 may include a first temperature sensor (indoor temperature sensor) included in the indoor unit 100 and a second temperature sensor (outdoor temperature sensor) included in the outdoor unit 200. The first temperature value may include at least one of an indoor unit first temperature value or an outdoor unit first temperature value, and the second temperature value may include at least one of an indoor unit second temperature value or an outdoor unit second temperature value.

The processor 120 may provide notification information related to an environment in which the air conditioner 1000 is installed based on the first temperature value (initial temperature of the indoor unit or initial temperature of the outdoor unit) and the second temperature value (temperature at the time of indoor unit detection or temperature at the time of outdoor unit detection).

In determining an abnormal environment of the outdoor unit and an abnormal environment of the indoor unit, the processor 120 may determine a priority. The processor 120 may decide whether to determine the abnormal environment of the indoor unit 100 first or the abnormal environment of the outdoor unit 200 first. The decision may be decided according to a threshold time. The threshold time corresponding to the first temperature sensor (indoor unit temperature sensor) may be longer than the threshold time corresponding to the second temperature sensor (outdoor unit temperature sensor). Reducing the threshold time of the outdoor unit temperature sensor may be to prevent malfunction of the outdoor unit 200 due to rapidly increasing temperature of the air-conditioning plant room. Accordingly, the processor 120 may first determine the abnormal environment of the outdoor unit 200 than the abnormal environment of the indoor unit 100, and may preventing malfunction of the air conditioner 1000.

When it is identified that the environment in which the outdoor unit 200 is installed does not satisfy a predetermined condition based on the first temperature value and the second temperature value obtained through the second temperature sensor (outdoor unit temperature sensor), the processor 120 may provide notification information related to the environment in which the outdoor unit 200 is installed, and may not provide notification information related to the environment in which the indoor unit 100 is installed. If the outdoor unit 200 is identified as having a failure, the indoor environment also has a high probability of an abnormal environment. When the ambient environment of the outdoor unit 200 is abnormal, the processor 120 may not analyze the ambient environment of the indoor unit 100. The detailed description will be described in FIG. 26 below.

The operation of identifying whether the ambient environment of the indoor unit 100 is an abnormal environment will be described. The processor may provide notification information related to an environment in which the indoor unit 100 is installed, if the difference between the indoor unit first temperature value obtained from the indoor unit temperature sensor and the set temperature value at the time where the threshold time has elapsed is equal to or greater than the first reference value (corresponding to the previous condition of the abnormal environment determination described above), and if the difference between the indoor unit first temperature value and the indoor unit second temperature value is less than or equal to a second reference value (corresponding to the first condition of the abnormal environment determination).

The air conditioner 1000 may further include a memory for storing information on the reference cooling rate for each initial temperature, and the processor 120 may identify the current cooling rate corresponding to the threshold time based on the first temperature value and the second temperature value. The current cooling rate corresponding to the threshold time may mean a temperature change rate based on the temperature value changed for a threshold time.

The processor 120 may identify a reference cooling rate corresponding to the first temperature value based on the information stored in the memory, and may provide notification information related to an environment in which the indoor unit 100 is installed based on a current cooling rate, a reference cooling rate, and a set temperature value of a time (abnormal environment detection time). When the initial set temperature is maintained, the set temperature value at the time when the initial set temperature and the threshold time have elapsed are the same, but when the set temperature is changed before the threshold time elapses, the set temperature value at the time when the threshold time has elapsed may be different from the initial set temperature. An embodiment in which the set temperature is changed will be described later with reference to FIGS. 15 and 16.

The air conditioner 1000 may further include a compressor, and the processor may provide notification information related to an environment in which the air conditioner 1000 is installed based on the first temperature value, the second temperature value, and the frequency of the compressor. The condition associated with the compressor frequency may correspond to a fourth condition of the above-described abnormal environment determination.

If the difference between the outdoor unit first temperature value obtained from the outdoor unit temperature sensor and the outdoor unit second temperature value at the time when the threshold time has elapsed is greater than or equal to the third reference value, the processor may identify that the current environment of the outdoor unit 200 is abnormal and may provide notification information.

The air conditioner 1000 may further include a memory for storing information on the reference temperature of the outdoor unit 200 for each initial temperature, and the processor may provide notification information related to the environment in which the outdoor unit 200 is installed, on the basis of the difference between the reference temperature of the outdoor unit 200 and the second temperature value of the outdoor unit 200 corresponding to the first temperature value of the outdoor unit. The outdoor unit reference temperature will be described in detail with reference to FIG. 12.

The air conditioner 1000 may use various methods in providing notification information. According to an embodiment, the air conditioner 1000 may further include a speaker, and the processor may control the speaker to provide notification information associated with the environment as a voice. According to another embodiment, the air conditioner 1000 may further include a communication interface, and the processor may control the communication interface to provide notification information associated with the environment to the external device. Various embodiments of the notification providing method will be described in detail with reference to FIGS. 4 to 10.

The condition corresponding to the exception of the notification information provision or data storage of the air conditioner 1000 will be described. If it is identified that the ambient environment of the outdoor unit 200 is abnormal, the processor 120 may not provide notification information related to the indoor unit 100. If it is identified that the ambient environment of the outdoor unit 200 is abnormal, the processor 120 may not store data related to the indoor unit 100 in the memory (or may not learn). If the air conditioner 1000 is in a specific mode (a low noise mode, a sleep mode, a pleasant sleep mode etc.), the air conditioner 1000 may not provide a notification in voice even if the abnormal environment is identified. In this example, the air conditioner 1000 may provide notification information using a display of the air conditioner 1000 or a display of an external device. When the air conditioner 1000 identifies the same abnormal environment as many as a predetermined number of times, the air conditioner 1000 may initialize the usage data (history data) stored in the memory. For example, if the processor 120 determines the window opening in the environment around the indoor unit 100 three times consecutively, all of the usage data stored in the existing memory may be initialized. Identifying an abnormal environment repeatedly may mean that the use environment is changed, so the air conditioner 1000 may initialize the existing data in order to analyze the environment based on the new data.

A subject of the operation of analyzing the temperature value obtained from the temperature sensor of the outdoor unit is described as the air conditioner 1000. Since the air conditioner 1000 may be the indoor unit 100, the outdoor unit 200, or a separate control apparatus, the operation of analyzing the temperature value may be performed by at least one of the indoor unit 100, the outdoor unit 200, or a separate control apparatus. For convenience, it is described herein that an analysis operation (an abnormal environment determination operation) is performed by the processor of the indoor unit 100.

The air conditioner 1000 according to an embodiment may directly provide a user with notification information and a user may be provided with information about an abnormal environment, not a failure of a product itself, and a user may perform self-action based on the notification information. Thus, a service consultation fee or a service fee that may occur by the service center may be saved. If the user performs a solution according to the notification information, the power consumption of the air conditioner 1000 may significantly decrease and energy may be saved.

In the description above, only an indoor unit temperature sensor or an outdoor unit temperature sensor are described, but the air conditioner 1000 may further include a heat exchanger temperature sensor, a humidity sensor, or the like, and may perform a determination operation for an abnormal environment based on the data obtained from the heat exchanger temperature sensor or the humidity sensor.

Figure 3:
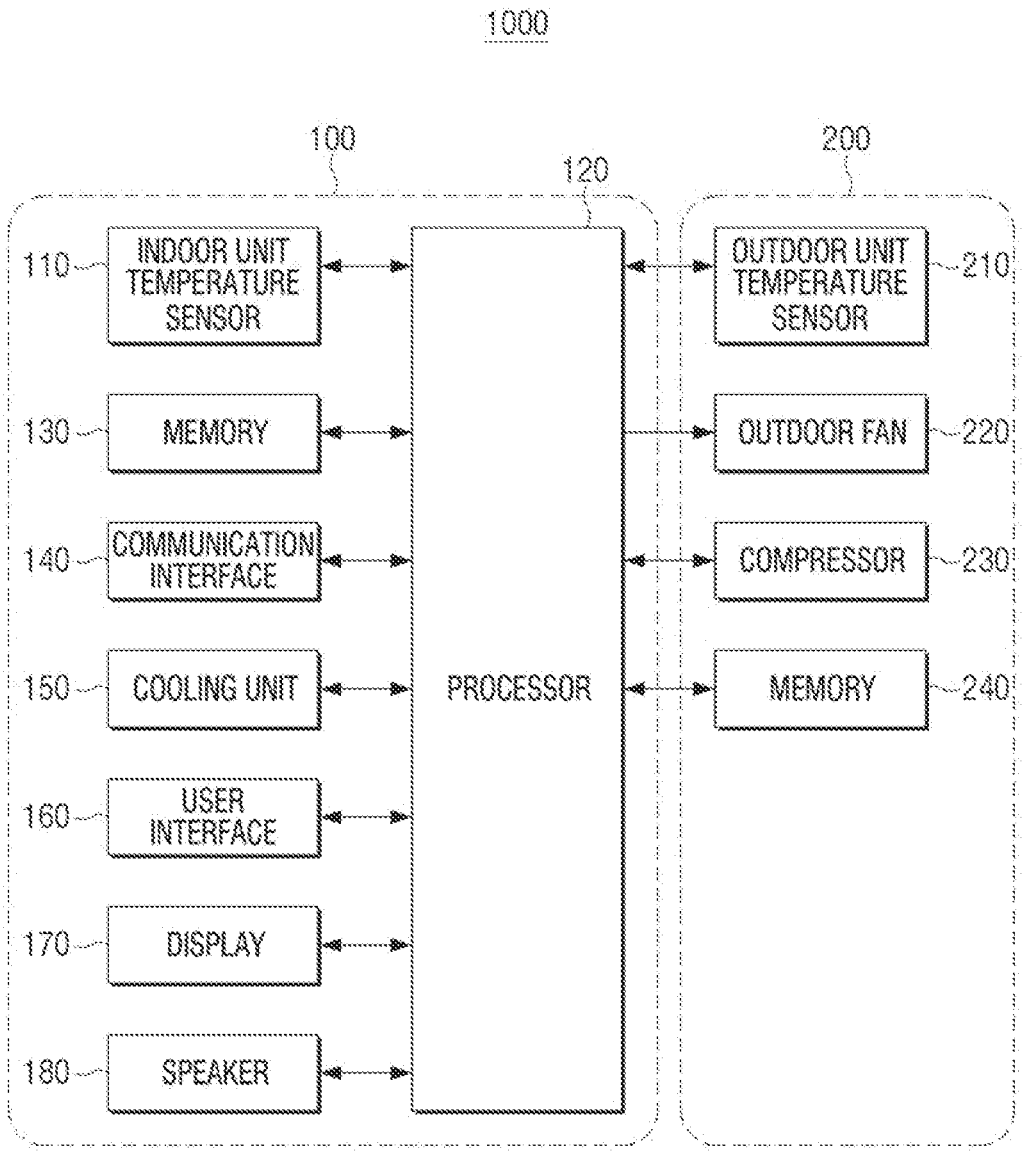
FIG. 3 is a block diagram illustrating a specific configuration of an indoor unit and an outdoor unit of FIG. 2.

FIG. 3 is a block diagram illustrating a specific configuration of an indoor unit and an outdoor unit of FIG. 2.

Referring to FIG. 3, the air conditioner 1000 may include the indoor unit 100 and the outdoor unit 200.

The indoor unit 100 may include the indoor unit temperature sensor 110, the processor 120, the memory 130, the communication interface 140, a cooling unit 150, a user interface 160, a display 170, and a speaker 180.

Among the operations of the temperature sensor 110 and the processor 120, the overlapped description with the above description will be omitted.

The processor 120 controls overall operations of the indoor unit 100 using various programs stored in the memory 130.

To be specific, the processor 120 includes at least one of a random access memory (RAM), a read-only memory (ROM), a main central processing unit (CPU), a first to $n^{th}$ interfaces, and a bus.

The RAM, the ROM, the main CPU, the first to $n^{th}$ interfaces, or the like, may be interconnected through the bus.

The ROM stores instruction set for botting the system and the like. When the turn-on command is input and power is supplied, the main CPU copies the OS stored in the memory 130 to the RAM according to a command stored in the ROM, and executes the OS to boot the system. When the booting is completed, the main CPU copies various application programs stored in the memory 130 to the RAM, may execute the application program copied to the RAM, and perform various operations.

The main CPU accesses the memory 130 and performs booting using an operating system (OS) stored in the memory 130, and may perform various operations using various programs, contents data, or the like, stored in the memory 130.

The first to $n^{th}$ interface are connected to the various elements described above. One of the interfaces may be a network interface connected to an external device through the network.

The processor 120 may perform a graphic processing function (video processing function). For example, the processor 120 may generate a screen including various objects such as icons, images, text, and the like. Here, a calculator (not shown) may calculate an attribute value such as a coordinate value, a shape, a size, and a color to be displayed by each object according to the layout of the screen based on the received control command A renderer (not shown) may generate display screens of various layouts including objects based on the attribute value calculated by the calculator (not shown). The processor 120 may perform various image processing such as decoding, scaling, noise filtering, frame rate conversion, resolution conversion, or the like, for the video data.

The processor 120 may perform processing of audio data. Specifically, the processor 120 may perform various image processing such as decoding, amplifying, noise filtering, and the like, on the audio data.

The memory 130 may be implemented as an internal memory such as a read-only memory (ROM) (for example, electrically erasable programmable read-only memory (EEPROM)) and a random-access memory (RAM) or a memory separate from the processor 120. In this case, the memory 130 may be implemented as at least one of a memory embedded within the indoor unit 100 or a memory detachable from the indoor unit 100 according to the usage of data storage. For example, the data for driving the indoor unit 100 may be stored in the memory embedded within the indoor unit 100, and the data for upscaling of the indoor unit 100 may be stored in the memory detachable from the indoor unit 100.

A memory embedded in the indoor unit 100 may be implemented as at least one of a volatile memory such as a dynamic random access memory (DRAM), a static random access memory (SRAM), a synchronous dynamic random access memory (SDRAM), or a non-volatile memory (for example, one time programmable ROM (OTPROM), programmable ROM (PROM), erasable and programmable ROM (EPROM), electrically erasable and programmable ROM (EEPROM), mask ROM, flash ROM, a flash memory (for example, NAND flash or NOR flash), a hard disk drive (HDD) or a solid state drive (SSD). In the case of a memory detachably mounted to the air conditioner 100, the memory may be implemented as a memory card (for example, a compact flash (CF), secure digital (SD), micro secure digital (micro-SD), mini secure digital (mini-SD), extreme digital (xD), multi-media card (MMC), etc.), an external memory (for example, a universal serial bus (USB) memory) connectable to the USB port, or the like.

The communication interface 140 may receive an audio content including an audio signal. For example, the communication interface 140 may receive an audio content including an audio signal by streaming or downloading from an external device (for example, a source device), an external storage medium (for example, a universal serial bus (USB) device), an external server (for example, a web server, etc.) through communication methods such as an access point (AP)-based Wi-Fi (wireless LAN network), Bluetooth, Zigbee, wired/wireless local area network (LAN), wide area network (WAN), Ethernet, IEEE 1394, high definition multimedia interface (HDMI), universal serial bus (USB), mobile high-definition link (MHL), advanced encryption standard (AES)/European broadcasting union (EBU), optical, coaxial, or the like.

The communication interface 140 may communicate with other external devices using various types of communication methods. The communication interface 140 includes at least one of a Wi-Fi module, a Bluetooth module, an infrared communication module, a wireless communication module, or the like. Each communication module may be implemented as or include at least one hardware chip.

The processor 120 may communicate with various external devices using the communication interface 140.

The Wi-Fi module and the Bluetooth module perform communication using a Wi-Fi method and a Bluetooth method, respectively. When using the Wi-Fi module or the Bluetooth module, various connection information such as a service set identifier (SSID) and a session key may be transmitted and received first, and communication information may be transmitted after communication connection.

The infrared ray communication module performs communication according to infrared data association (IrDA) technology that transmits data wireless to a local area using infrared ray between visible rays and millimeter waves.

The wireless communication module refers to a module performing communication according to various communication standards such as Zigbee, $3^{rd}$ generation (3G), $3^{th}$ generation partnership project (3GPP), long term evolution (LTE), LTE advanced (LTE-A), $4^{th}$ generation (4G), $5^{th}$ generation (5G), or the like, in addition to the communication methods as described above.

The communication interface 140 may include at least one of a local area network (LAN) module, Ethernet module, or wired communication module performing communication using a pair cable, a coaxial cable, an optical cable, or the like.

According to an embodiment, the communication interface 140 may use the same communication module (for example, Wi-Fi module) for communicating with an external device such as a remote controller and an external server.

According to another example, the communication interface 140 may use a different communication module (for example, a Wi-Fi module) to communicate with an external server and an external device such as a remote controller. For example, the communication interface 140 may use at least one of an Ethernet module or a Wi-Fi module to communicate with the external server, and may use a Bluetooth (BT) module to communicate with an external device such as a remote controller. However, this is only an example and the communication interface 140 may use at least one communication module among various communication modules when communicating with a plurality of external devices or external server in other implementations.

The cooler 150 is configured to condition indoor air by discharging temperature-controlled air. The cooler 150 may include an indoor heat exchanger, an expansion valve, a ventilation fan, or the like.

The indoor heat exchanger may exchange heat with a refrigerant provided by the outdoor unit and the air introduced into the indoor unit 100. The indoor heat exchanger may perform a role of an evaporator in cooling. The indoor heat exchanger may cause the refrigerant which is in a fog state of low pressure and low temperature to absorb latent heat required for phase transition for the refrigerant to evaporate into air from the air introduced into the indoor unit 100. Conversely, the indoor heat exchanger may perform a role of a condenser in heating. If flow of a refrigerant is reversed on the contrary to cooling, heat of a refrigerant passing the indoor heat exchanger may be discharged to air introduced to the indoor unit 100.

The expansion valve may control pressure of the refrigerant. The expansion valve may lower pressure by expanding refrigerant of high pressure and low temperature that passes an outdoor heat exchanger in cooling. The expansion valve may control an amount of refrigerant introduced to the indoor heat exchanger. The expansion valve may reduce pressure by expanding a refrigerant of low pressure and high temperature before transferring the refrigerant that passes through the indoor heat exchanger to the outdoor heat exchanger in heating. The amount of refrigerant introduced to the outdoor heat exchanger may be controlled.

The ventilation fan may introduce the outdoor air into the inside of the indoor unit 100, and may discharge air with different temperature by heat exchange to the outside of the indoor unit 100.

The cooler 150 may control intensity of wind, temperature of air discharged to the indoor space, or the like, according to the control of the processor 120.

For convenience, a configuration to control temperature of air is referred to as the cooler 150, but it is not limited to cooling, and air conditioning of a least one of heating to raise temperature of indoor air, ventilation of forming air current indoor, and dehumidification to lower indoor humidity may be performed.

The user interface 160 may be implemented using a device such as a button, a touch pad, a mouse, a keyboard, or a touch screen capable of performing the above-described display function and manipulation input function. Here, the button may be various types of buttons such as a mechanical button, a touch pad, a wheel, or the like, formed in an arbitrary region such as a front portion, a side portion, a back portion, or the like, of the outer surface of the main body of the indoor unit 100.

The display 170 includes a display panel to output an image. The display panel may be implemented as various types of panels such as a liquid crystal display (LCD) panel, organic light emitting diodes (OLED) display panel, a plasma display panel (PDP), and the like. In the display 170, a backlight unit, a driving circuit, or the like that may be implemented as a-si TFT, low temperature poly silicon (LTPS) TFT, organic TFT (OTFT), or the like, may be included. Further, the display 170 may be implemented as at least one of a touch screen coupled with a touch sensor, a flexible display, a three-dimensional (3D) display, or the like.

The speaker 180 is configured to output not only audio data but also various notification sounds, audio message, or the like. The speaker 180 may output notification information about an abnormal environment as voice.

The outdoor unit 200 may include an outdoor unit temperature sensor 210, an outdoor fan 220, a compressor 230, and a memory 240.

The outdoor unit temperature sensor 210 may be configured to sense the temperature of a space in which the outdoor unit 200 is installed. According to an embodiment, when the outdoor unit 200 is installed outdoors, the outdoor unit temperature sensor 210 may sense the outdoor temperature. According to another embodiment, when the outdoor unit 200 is installed in the air-conditioning plant room, the outdoor unit temperature sensor 210 may sense the temperature of the air-conditioning plant room. The outdoor unit temperature sensor 210 may be disposed (or installed) anywhere where the temperature may be sensed.

The outdoor fan 220 may be configured to forcibly discharge outdoor air by the outdoor fan motor to exchange heat in the outdoor heat exchanger. The rotational rate of the outdoor fan 220 may be changed based on a control signal transmitted from the processor 120.

The compressor 230 is configured to compress a refrigerant in gas of high temperature and high pressure.

The memory 240 is configured to store setting information, control information, or other information related to an outdoor unit.

Figure 4:
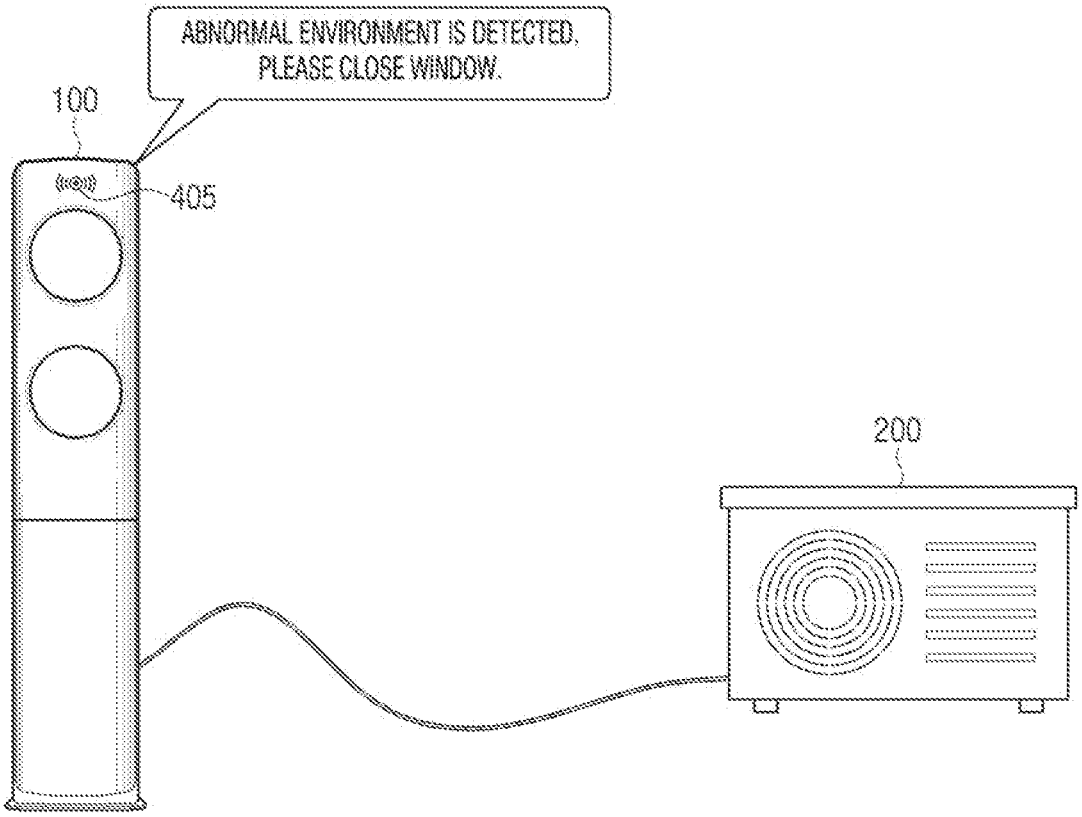
FIG. 4 is a diagram illustrating a method of providing notification information according to an embodiment of the disclosure.

FIG. 4 is a diagram illustrating a method of providing notification information according to an embodiment of the disclosure.

Referring to FIG. 4, the indoor unit 100 may include a speaker 405. The speaker 405 may be disposed outside the indoor unit 100. When the environment in which the air conditioner 1000 is installed is identified as an abnormal environment, the air conditioner 1000 may output a notification related to an environment in which the air conditioner 1000 is installed through the speaker 405. The notification may include information about whether an abnormal environment is sensed and whether the abnormal environment is detected. If the notification information is outputted as a voice, the user may immediately perform the corresponding operation, the power of the air conditioner 1000 may be saved.

Referring to FIG. 4, the speaker 405 according to an embodiment is disposed at the upper end of the indoor unit 100. However, according to another embodiment, the speaker 405 may be disposed at a lower end portion or a rear surface portion other than the upper end portion.

Figure 5:
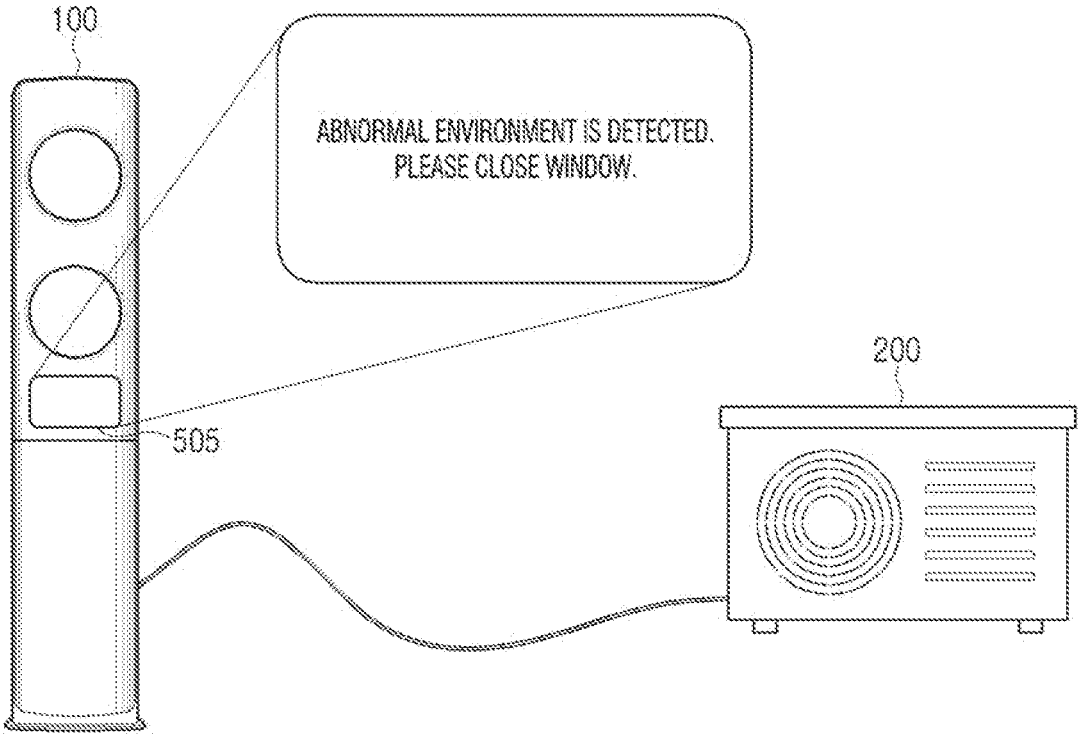
FIG. 5 is a diagram illustrating a method of providing notification information according to another embodiment of the disclosure.

FIG. 5 is a diagram illustrating a method of providing notification information according to another embodiment of the disclosure.

Referring to FIG. 5, the indoor unit 100 may include a display 505. The display 505 may be disposed outside the indoor unit 100. When the environment in which the air conditioner 1000 is installed is identified as an abnormal environment, the air conditioner 1000 may output the notification related to the environment in which the air conditioner 1000 is installed through the display 505. The notification may include information about whether an abnormal environment is sensed and whether the abnormal environment is detected.

According to another embodiment, the indoor unit 100 may include a speaker 405 and a display 505 at the same time. When the environment in which the air conditioner 1000 is installed is identified as an abnormal environment, the air conditioner 1000 may output a notification related to an environment in which the air conditioner 1000 is installed through at least one of the speaker 405 or the display 505.

Figure 6:
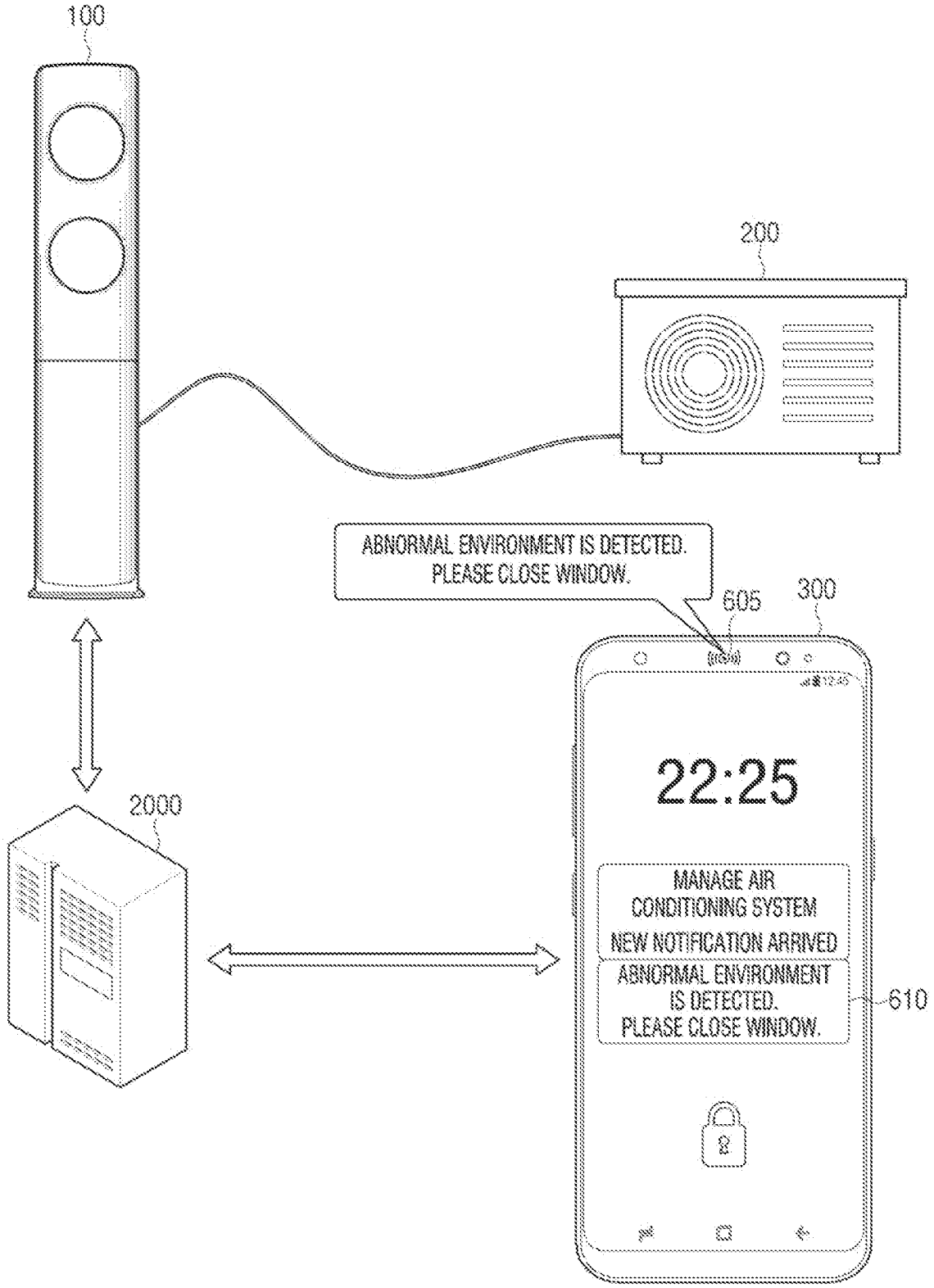
FIG. 6 is a diagram illustrating a method of providing notification information according to still another embodiment of the disclosure.

FIG. 6 is a diagram illustrating a method of providing notification information according to still another embodiment of the disclosure.

Referring to FIG. 6, the indoor unit 100 may use a server 2000 to provide notification of an abnormal environment. When the environment in which the air conditioner 1000 is installed is identified as an abnormal environment, the indoor unit 100 may transmit notification information about the abnormal environment to the server 2000.

The server 2000 may be a cloud server. The notification information for the abnormal environment transmitted to the server 2000 may be code information corresponding to the abnormal environment. The server 2000 may identify what is an abnormal environment of the air conditioner 1000 based on the received code information and identify a solution of the identified abnormal environment. The server 2000 may transmit information on the abnormal environment and a solution corresponding to the identified abnormal environment to the user terminal device 300.

The server 2000 may store the user terminal device 300 corresponding to the specific air conditioner 1000 as one group. The server 2000 may identify a user terminal device 300 corresponding to a specific air conditioner 1000 among the information stored in the group, and may provide notification information for an abnormal environment to the identified user terminal device 300.

The user terminal device 300 may output notification information about the abnormal environment based on the information received from the server 2000. The user terminal device 300 may include at least one of a speaker 605 or a display. The user terminal device 300 may output notification information about an abnormal environment using at least one of the speaker 605 or a display.

According to an embodiment, the user terminal device 300 may output notification information about an abnormal environment through the speaker 605.

According to another embodiment, the user terminal device 300 may output notification information about the abnormal environment using a UI 610 displayed on the display. The UI 610 may include at least one of information indicating whether a notification is provided (e.g., "air conditioning system management, new notification arrival"), whether an abnormal environment is sensed (e.g., "abnormal environment is detected") or resolution information (e.g., "please close a window") corresponding to an abnormal environment.

Figure 7:
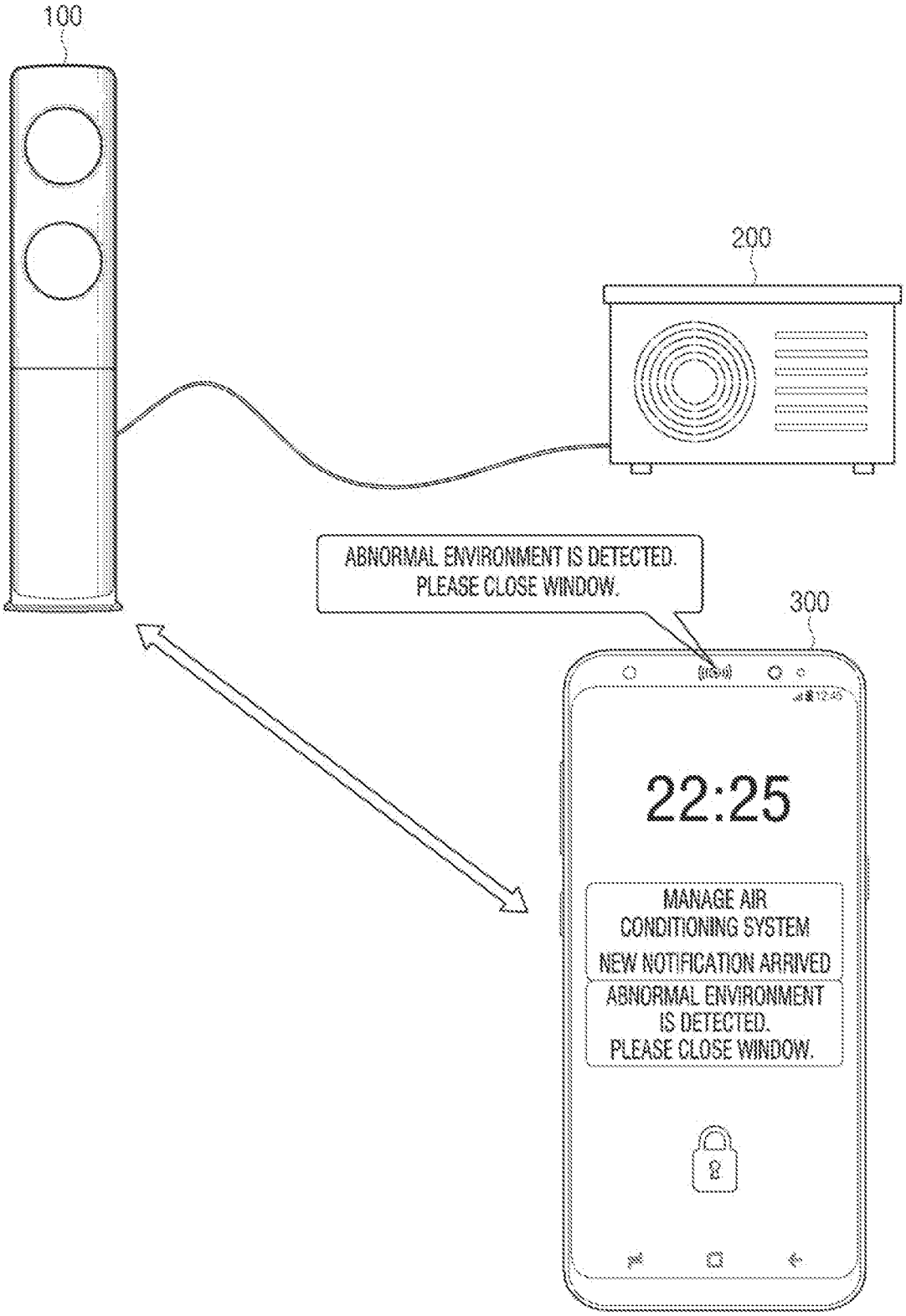
FIG. 7 is a diagram illustrating a method of providing notification information according to still another embodiment of the disclosure.

FIG. 7 is a diagram illustrating a method of providing notification information according to still another embodiment of the disclosure.

Referring to FIG. 7, the indoor unit 100 may transmit notification information about an abnormal environment directly to the user terminal device 300. The user terminal device 300 may mean a device paired with the indoor unit 100. When the environment in which the air conditioner 1000 is installed is identified as an abnormal environment, the indoor unit 100 may directly transmit notification information about the abnormal environment to the paired user terminal device 300 through the communication interface.

The notification information about an abnormal environment output from the user terminal device 300 is overlapped with FIG. 6 and a specific description will be omitted.

Figure 8:
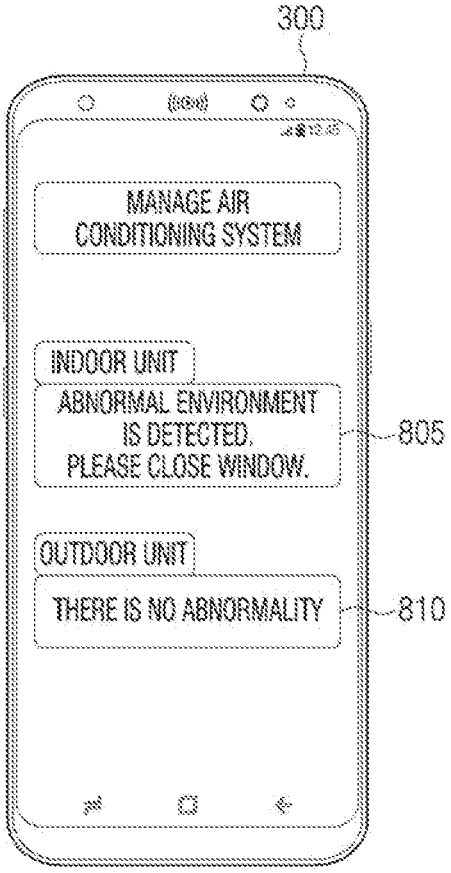
FIG. 8 is a diagram describing notification information displayed on a display according to an embodiment of the disclosure.

FIG. 8 is a diagram describing notification information displayed on a display according to an embodiment of the disclosure.

Referring to FIG. 8, the user terminal device 300 may output notification information about the abnormal environment using the UI. The user terminal device 300 may display the UI on the display to provide notification information about the abnormal environment to the user. The UI providing notification information about the abnormal environment may include at least one of a UI 805 providing information about the indoor unit 100 or a UI 810 providing information about the outdoor unit 200.

The user terminal device 300 may display the abnormal state of the environment or a solution of an environment in which the indoor unit 100 is installed by using a UI 805 providing information about the indoor unit 100.

The user terminal device 300 may display at least one of an abnormal state or a solution of an environment in which the outdoor unit 200 is installed using a UI 810 that provides information about the outdoor unit 200.

Figure 9:
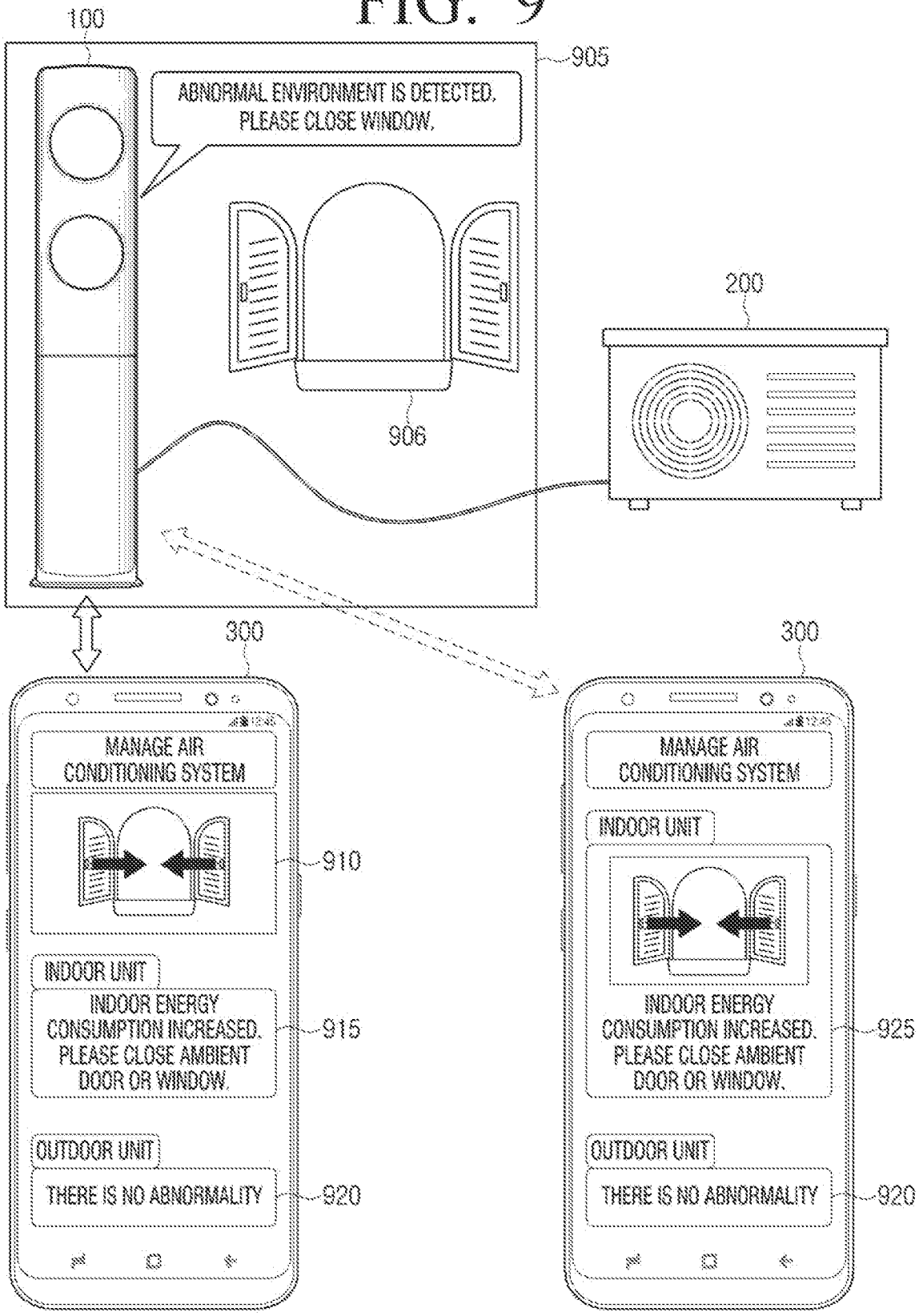
FIG. 9 is a diagram describing notification information displayed on a display according to another embodiment of the disclosure.

FIG. 9 is a diagram describing notification information displayed on a display according to another embodiment of the disclosure.

Referring to FIG. 9, the indoor unit 100 may be disposed in an indoor space 905. The indoor space 905 may ventilate air through a window 906. The window 906 may be a passage through which external air enters the indoor space 905 or a passage through which the internal air exits the room. It is assumed that the air conditioner 1000 is operated in hot summer. If the window 906 is not closed, the external air may continue to flow into the indoor space 905. Therefore, the indoor temperature may not fall despite the operation of the air conditioner 1000. If no notification is provided to the user, the air conditioner 1000 continues to operate, so that the amount of power may be significantly wasted.

The air conditioner 1000 according to an embodiment may measure the indoor temperature using the temperature sensor of the indoor unit 100. The air conditioner 1000 may determine whether the environment around the place where the indoor unit 100 is installed is normal or abnormal based on the change in the indoor temperature and the set temperature. If the environment around the place where the indoor unit 100 is installed is abnormal, the air conditioner 1000 may provide notification information about the abnormal environment to the user. For example, the indoor unit 100 may determine whether the ambient environment of the indoor space 905 where the indoor unit 100 is installed is normal or abnormal. The indoor unit 100 may measure a temperature change amount by using a temperature sensor included in the indoor unit, and may analyze the measured temperature change and the set temperature. The indoor unit 100 may determine that the window 906 of the indoor space 905 is open when the indoor temperature does not significantly fall than the set temperature even after the threshold time. A situation in which the window 906 of the indoor space 905 is opened may be an abnormal situation in operation of the indoor unit 100, and the indoor unit 100 may determine the surrounding environment of the indoor space 905 where the indoor unit 100 is installed as an abnormal state. The indoor unit 100 may provide notification information about the abnormal environment to the user.

The method of providing notification information to a user may vary as described in FIGS. 4 to 7. For convenience, referring to FIGS. 9 and 10, a method of providing notification information to a user may display information on a display of the paired user terminal device 300.

The indoor unit 100 may transmit notification information about the abnormal environment to the user terminal device 300, and the user terminal device 300 may display the notification information for the abnormal environment on the display. The notification information about the abnormal environment may include a UI 910 for displaying a solution corresponding to an abnormal environment as a picture or a video, a UI 915 for providing information about the indoor unit 100, and a UI 920 for providing information about the outdoor unit 200.

The UI 910, which displays a solution corresponding to the abnormal environment as a picture, may include an intuitive picture or a video about how the user should behave in an abnormal environment. If the user's behavior is provided as a picture or a video, the user may easily understand the solution to the abnormal environment.

The UI 915 providing information about the indoor unit 100 may display information about whether an environment around a space in which the indoor unit 100 is installed or a solution thereof. Here, the information may mean text information.

A UI 920 providing information about the outdoor unit 200 may display information about whether an environment around the space in which the outdoor unit 200 is installed is abnormal or information about a solution. Here, the information may mean text information.

According to an embodiment, the notification information about the abnormal environment may be provided by dividing a UI 910 providing the picture or the video, a UI 915 providing information on the indoor unit 100, and a UI module 920 providing information on the outdoor unit 200.

The notification information for the abnormal environment according to another embodiment may be provided by combination of a UI 910 for providing a picture or a video, a UI 915 for providing information about the indoor unit 100, and a UI 920 for providing information about the outdoor unit 200. For example, the notification information for the abnormal environment may be provided using a UI 925 in the form of combining a picture or video including information (text information) for the indoor unit 100 and a solution for an abnormal environment.

Figure 10:
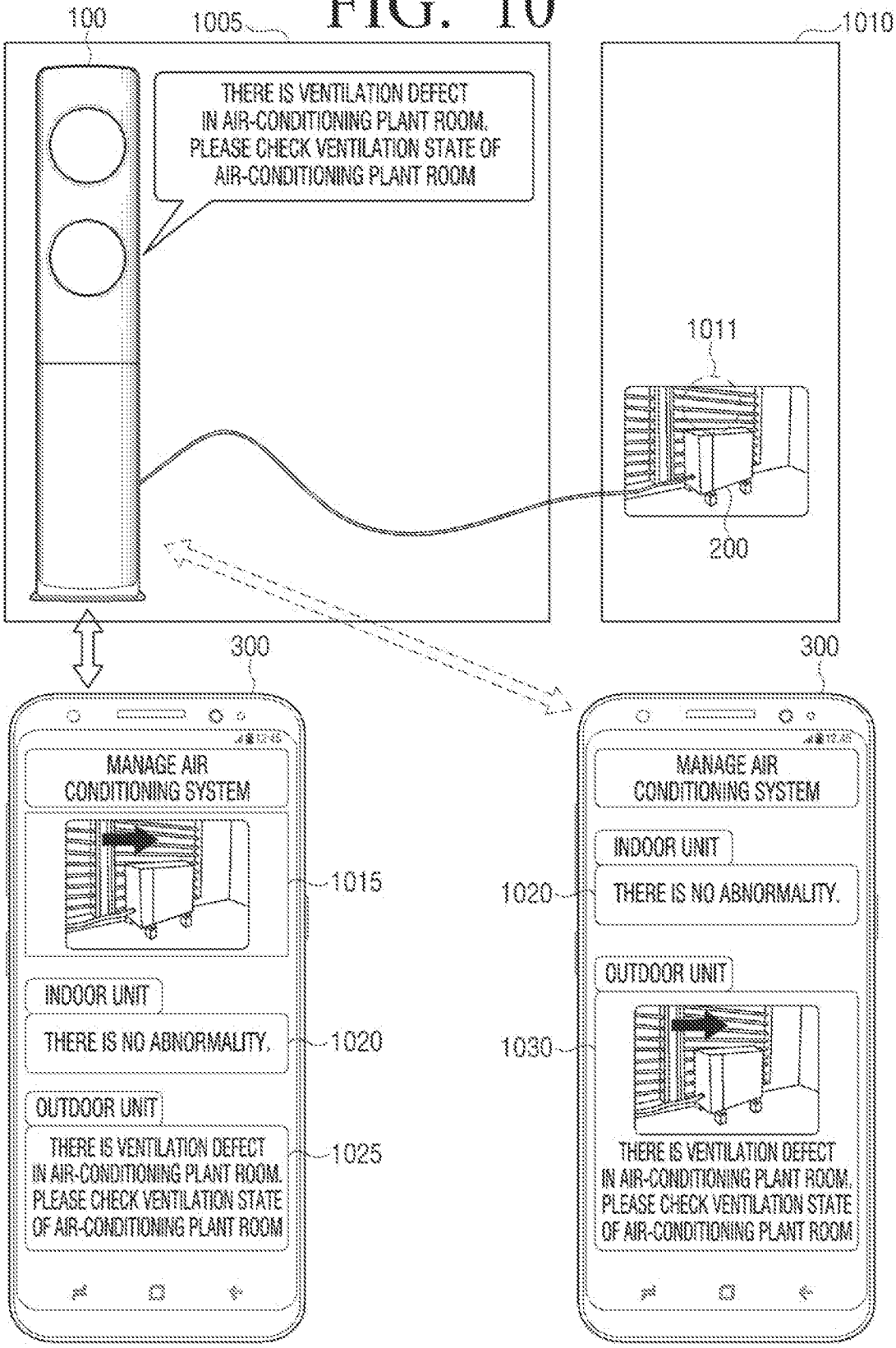
FIG. 10 is a diagram describing notification information displayed on a display according to still another embodiment of the disclosure.

FIG. 10 is a diagram describing notification information displayed on a display according to still another embodiment of the disclosure.

Referring to FIG. 10, the indoor unit 100 may be disposed in an indoor space 1005, and the outdoor unit 200 may be disposed in an air-conditioning plant room 1010. The outdoor unit 200 may be disposed outside the outdoor unit 200. However, the outdoor unit 200 may be disposed in an indoor room or indoor space rather than the outside. FIG. 10 illustrates a case where the outdoor unit 200 is disposed indoors. The air-conditioning plant room 1010 may be an indoor space and may include a window 1011 to circulate air to the outside. The outdoor unit 200 may discharge hot air to the outside of the window 1011. If the window 1011 is not opened, the hot air discharged from the outdoor unit 200 may not be discharged to the outside. If the hot air discharged from the outdoor unit 200 is accumulated in the air-conditioning plant room 1010, the temperature of the air-conditioning plant room 1010 may rise and the performance of the outdoor unit 200 may be deteriorated. Accordingly, the situation in which the window of the air-conditioning plant room 1010 is closed may be classified into an abnormal environment.

The air conditioner 1000 according to an embodiment may measure the temperature of the air-conditioning plant room 1010 using the temperature sensor of the outdoor unit 200. The air conditioner 1000 may determine whether the environment around the place where the outdoor unit 200 is installed is normal or abnormal based on the amount of change in the temperature of the air-conditioning plant room 1010. If the environment around the place where the outdoor unit 200 is installed is abnormal, the air conditioner 1000 may provide notification information about the abnormal environment to the user.

The air conditioner 1000 may measure a temperature change amount by using a temperature sensor included in the outdoor unit 200, and may analyze the measured temperature change. The air conditioner 1000 may determine that the window 1011 of the air-conditioning plant room 1010 is closed when the air-conditioning plant room 1010 temperature rises above or equal to a reference value for a threshold time. Since the state in which the window 1011 of the air-conditioning plant room 1010 is closed may be an abnormal normal situation in operation of the outdoor unit 200, the air conditioner 1000 may determine the ambient environment of the air-conditioning plant room 1010 in which the outdoor unit 200 is installed as an abnormal state. The air conditioner 1000 may provide notification information about the abnormal environment to the user.

The air conditioner 1000 may transmit notification information about the abnormal environment to the user terminal device 300, and the user terminal device 300 may display the notification information for the abnormal environment on the display. The notification information about the abnormal environment may include a UI 1015 for displaying a solution corresponding to an abnormal environment as a picture or a video, a UI 1020 for providing information about the indoor unit 100, and a UI 1025 for providing information about the outdoor unit 200.

According to an embodiment, the notification information about the abnormal environment may be provided by dividing the UI 1015 providing the picture or the video, the UI 1020 providing information on the indoor unit 100, and the UI 1025 providing information on the outdoor unit 200.

The notification information for the abnormal environment according to another embodiment may be provided with a UI 1015 for providing a picture or a video, a UI 1020 for providing information about the indoor unit 100, and a UI 1025 for providing information about the outdoor unit 200. For example, the notification information for the abnormal environment may be provided using a UI 1030 in which a picture or a video including information (text information) for the outdoor unit 200 and a solution for an abnormal environment are combined.

Description of each UI disclosed in FIG. 10 is overlapped with the description of FIG. 9 and thus will be omitted.

FIG. 11 is a diagram illustrating a reference cooling rate associated with indoor temperature.

Referring to FIG. 11, the air conditioner 1000 may store a reference cooling rate according to an initial temperature in a memory. The cooling rate may mean changes in temperature over time. In the specification, the cooling rate is calculated as a change in temperature per minute. For example, it is assumed that the temperature has changed from 30 to 21 degrees for 30 minutes. Here, since the temperature drops by 9 degrees for 30 minutes, the cooling rate may be 0.3.

The reference cooling rate may mean the measured cooling rate when the environment in which the indoor unit 100 is installed is normal. The initial temperature may mean the indoor temperature at the time when the air conditioner 1000 receives the turn-on command or the indoor temperature at the time when the air conditioner 1000 starts cooling. The indoor temperature may be obtained through a temperature sensor of the indoor unit 100.

The reference cooling rate according to an embodiment may be data obtained according to the operation of the air conditioner 1000 after the initial air conditioner 1000 is installed. When the user initially installs the air conditioner 1000, the air conditioner 1000 may operate the air conditioner 1000 for a predetermined number of times and may store the sample data in the memory. The air conditioner 1000 may analyze stored sample data and may analyze a cooling rate in a normal environment. The air conditioner 1000 may determine an average cooling rate as a reference cooling rate and store the determined reference cooling rate in a memory.

The reference cooling rate according to another embodiment may be predetermined data. The reference cooling rate may be data obtained through average calculation of sample data, and may be a preset value according to a type of the air conditioner 1000.

The reference cooling rate may vary depending on the initial temperature. In general, assuming that the set temperature of the air conditioner 1000 is 20° to 24°, the higher the initial temperature, the higher the cooling rate. The reference cooling rate may be stored differently depending on the initial temperature.

A table 1105 of FIG. 11 indicates the reference cooling rate for each initial temperature as a table. The reference cooling rate may be faster as the initial temperature is higher. The reference cooling rate may be used for determining whether the environment is abnormal or not. The air conditioner 1000 may obtain a temperature change amount from the temperature sensor of the indoor unit 100. The air conditioner 1000 may obtain a current cooling rate based on the obtained temperature change. The air conditioner 1000 may compare the reference cooling rate and the obtained current cooling rate stored in the table 1105. If the difference between the reference cooling rate and the current cooling rate is greater than or equal to a reference value, the air conditioner 1000 may determine that the surrounding environment of the place where the indoor unit 100 is installed is abnormal.

FIG. 12 is a table illustrating reference temperature associated with an outdoor unit.

Referring to FIG. 12, a table 1205 indicates the outdoor unit reference temperature according to the initial temperature as a table. The air conditioner 1000 may store an outdoor reference temperature in a memory. The outdoor unit reference temperature may mean an expected temperature of the outdoor unit at a time after a threshold time has elapsed from the time when the air conditioner 1000 receives a turn-on command. The air conditioner 1000 may obtain the outdoor unit temperature from the temperature sensor of the indoor unit 100. The outdoor unit 200 may receive a control command to measure the temperature from the air conditioner 1000, and when a control command is received, the outdoor unit 200 may measure the temperature using the temperature sensor of the outdoor unit 200. The outdoor unit 200 may transmit the measured temperature sensor to the air conditioner 1000.

According to an embodiment, the outdoor unit reference temperature may be preset data. For example, a predetermined value may be set to an outdoor unit reference temperature through a product installation step, a software upgrade, or the like. A manufacturer may perform a test or collect data of users to determine the outdoor unit reference temperature as sample data.

According to another embodiment, the outdoor unit reference temperature may be determined on the basis of data obtained by performing a cooling operation by a predetermined number of times after the product is installed. Whenever performing a cooling operation, the temperature sensor of the outdoor unit 200 may measure the temperature of the outdoor unit at a time when a threshold time elapses after a turn-on command by a predetermined number of times. The air conditioner 1000 may calculate the outdoor unit reference temperature according to the initial temperature by synthesizing the measured (or stored) data by a predetermined number of times.

The air conditioner 1000 may determine whether the outdoor unit 200 is abnormal based on the temperature change obtained from the outdoor unit temperature sensor. The air conditioner 1000 may determine the temperature of the outdoor unit at the time when the turn-on command is received as the initial temperature, and may determine that the ambient environment of the place where the outdoor unit 200 is installed is abnormal if the difference value between the outdoor unit temperature at the time when the threshold time has elapsed and the outdoor unit reference temperature corresponding to the initial temperature is equal to or greater than the reference value.

For example, it is assumed that, at the time when the turn-on command is received, the outdoor unit temperature is 30 degrees, the threshold time is 30 minutes, and the reference value is 3. The initial temperature is 30 degrees and may correspond to group 4 of table 1205. Thus, the outdoor reference temperature corresponding to the initial temperature 30 may be 34 degrees.

If the outdoor unit temperature is 34 degrees after 30 minutes from the time when the turn-on command is received, the difference value between the outdoor unit temperature 34 and the outdoor unit reference temperature 34 may be zero. Accordingly, the air conditioner 1000 may determine that the ambient environment of the place where the outdoor unit is installed is normal. However, if the outdoor unit temperature is 38 degrees after 30 minutes from the time when the turn-on command is received, the difference value between the outdoor unit temperature (38 degrees) and the outdoor unit reference temperature (34 degrees) may be 4 degrees. Since the difference value (4 degrees) is greater than the reference value 3, the air conditioner 1000 may determine that the ambient environment of the place where the outdoor unit is installed is abnormal.

Figure 13:
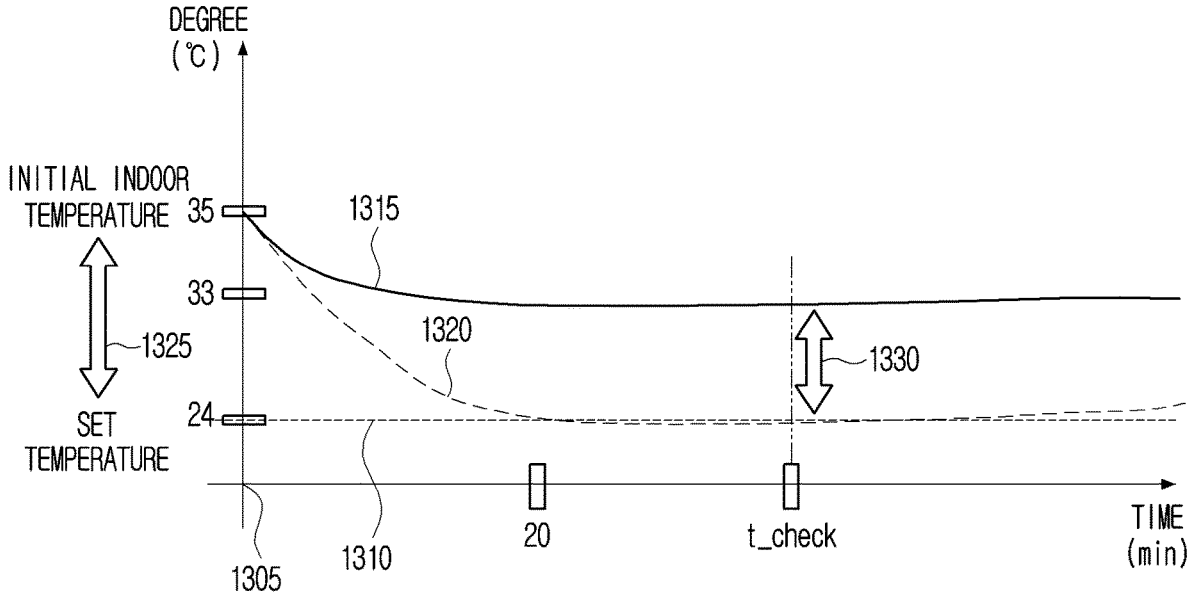
FIG. 13 is a diagram illustrating one embodiment of detecting an abnormal environment according to temperature change of an indoor unit.

FIG. 13 is a diagram illustrating one embodiment of detecting an abnormal environment according to temperature change of an indoor unit.

Referring to FIG. 13, a graph 1305 displays temperature information obtained from a temperature sensor of the indoor unit 100. The x-axis of the graph 1305 refers to a time, the unit is a minute, the y-axis is a temperature, and the unit may be temperature (centigrade). The "t_check" may be a time at which the threshold time has elapsed from receiving the turn-on command (hereinafter, referred to as a detection time or an abnormal environment detection time).

A graph 1305 may include a set temperature 1310, a measured temperature 1315, and an expected temperature 1320. The set temperature 1310 may refer to at least one of a temperature directly set by a user, a temperature stored in a previous cooling operation, or a predetermined temperature. The measured temperature 1315 may mean the temperature obtained from the temperature sensor of the current indoor unit 100. The expected temperature 1320 may mean an expected indoor temperature when the ambient environment of the air conditioner 1000 is normal. The expected temperature 1320 may be the previous temperature data of the air conditioner 1000 changing over time. The expected temperature 1320 may mean indoor temperature data of the air conditioner 1000 which operates in a normal environment.

The air conditioner 1000 may determine whether the ambient environment of the indoor unit 100 is abnormal after a threshold time (hereinafter, referred to as an abnormal environment determination). The air conditioner 1000 may determine an abnormal environment of the air conditioner 1000 based on a set temperature, an initial temperature, and a detection time temperature. The initial temperature may mean the temperature measured at the time when the air conditioner 1000 receives the turn-on command.

The air conditioner 1000 may determine an abnormal environment only when the difference value 1325 between the set temperature and the initial temperature is equal to or greater than a reference value. The reason of setting a reference value is that, if the difference between the set temperature and the initial temperature is small, the accuracy of the determination of the abnormal environment may be lowered. For example, assuming that the reference value is 3 degrees, in a graph 1305, a set temperature is 24 degrees and an initial indoor temperature is 35 degrees, so that the difference value (11 degree) is greater than the reference value (3 degrees). Therefore, the air conditioner 1000 may determine whether the air conditioner 1000 is in an abnormal environment.

When the difference value 1330 between the set temperature and the detection time is equal to or greater than the reference value, the air conditioner 1000 may determine that the current environment is an abnormal environment. For example, it is assumed that the reference value is 5 degrees. In FIG. 13, the set temperature is 24 degrees and the detection time temperature is 33 degrees, and the difference value (9 degrees) is greater than the reference value (5 degrees). Accordingly, the air conditioner 1000 may identify the current environment (ambient environment of the indoor unit 100) as an abnormal environment.

The air conditioner 1000 may determine that the current environment is an abnormal environment when the difference value between the expected temperature and the detection time temperature is equal to or greater than a reference value. For example, it is assumed that the reference value is 4 degrees. In FIG. 13, the expected temperature is 24 degrees and the detection time temperature is 33 degrees, and thus the difference value (9 degrees) is greater than the reference value (4 degrees). Accordingly, the air conditioner 1000 may identify the current environment (ambient environment of the indoor unit 100) as an abnormal environment.

When the difference value between the reference cooling rate and the current cooling rate is greater than or equal to a reference value, the air conditioner 1000 may determine that the current environment is an abnormal environment. For example, it is assumed that the reference value is 0.1. The reference cooling rate may be determined according to the initial temperature. According to the table 1105 of FIG. 11, the reference cooling rate corresponding to the initial temperature 35 degrees may be 0.27. The current cooling rate may be (35−33)/30=0.067 (rounding off the four place of decimals). The difference value of the reference cooling rate 0.27 and the current cooling rate 0.067 may be 0.203. Since the difference value 0.203 is greater than the reference value 0.1, the air conditioner 1000 may identify the current environment (ambient environment of the indoor unit 100) as an abnormal environment.

The various abnormal environment determination conditions described in FIG. 13 may be applied separately or combined according to the user's setting. Each of the reference values described in FIG. 13 may be different from each other and may vary depending on the initial temperature.

Figure 14:
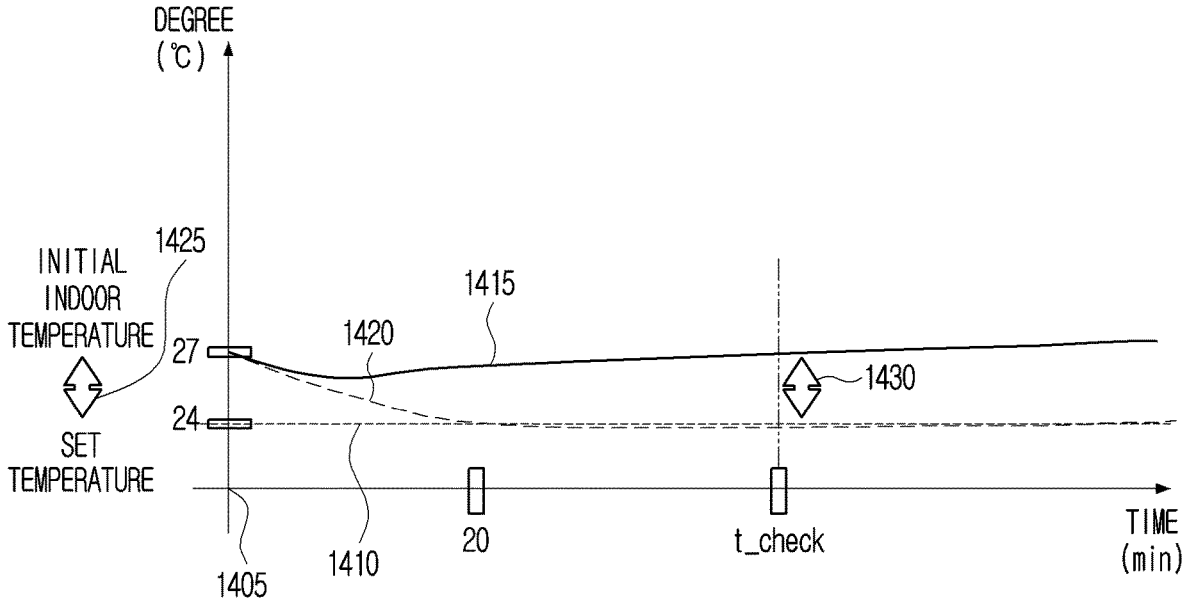
FIG. 14 is a diagram illustrating another embodiment of detecting an abnormal environment according to temperature change of an indoor unit.

FIG. 14 is a diagram illustrating another embodiment of detecting an abnormal environment according to temperature change of an indoor unit.

Referring to FIG. 14, a graph 1405 represents temperature information obtained from a temperature sensor of the indoor unit 100. The graph 1405 may include a set temperature 1410, a measured temperature 1415, and an expected temperature 1420. The detailed description will be omitted since it is the same as that described with reference to FIG. 13.

The air conditioner 1000 may determine an abnormal environment only when a difference value 1425 between the set temperature and the initial temperature is equal to or greater than a reference value. For example, assuming that the reference value is 3, in the graph 1405, the set temperature is 24 degrees and the initial indoor temperature is 27 degrees, so the difference value (3 degrees) is the same as the reference value (3 degrees). Therefore, the air conditioner 1000 may determine whether the air conditioner 1000 is in an abnormal environment (If the reference value is 4, the air conditioner 1000 may not determine whether the air conditioner 1000 is in an abnormal environment).

When a difference value 1430 between the set temperature and the detection point temperature is equal to or greater than the reference value, the air conditioner 1000 may determine that the current environment is an abnormal environment. For example, it is assumed that the reference value is 2 degrees (since the initial temperature is different, the reference value is different from the reference value of FIG. 13). Referring to FIG. 14, the set temperature is 24 degrees and the detection point temperature is 27 degrees, and thus the difference value (3 degrees) is greater than the reference value (2 degrees). Accordingly, the air conditioner 1000 may identify the current environment (ambient environment of the indoor unit 100) as an abnormal environment.

The air conditioner 1000 may determine that the current environment is an abnormal environment when the difference value between the expected temperature and the detection time is equal to or greater than a reference value. For example, it is assumed that the reference value is 2 degrees (since the initial temperature is different, the reference value is different from the reference value of FIG. 13). The expected temperature is 24 degrees and the detection time temperature is 27 degrees, and thus the difference value (3 degrees) is greater than the reference value (2 degrees). The air conditioner 1000 may identify the current environment (ambient environment of the indoor unit 100) as an abnormal environment.

When the difference value between the reference cooling rate and the current cooling rate is greater than or equal to the reference value, the air conditioner 1000 may determine that the current environment is an abnormal environment. For example, it is assumed that the reference value is 0.1. The reference cooling rate may be determined according to the initial temperature. According to a table 1105 of FIG. 11, the reference cooling rate corresponding to the initial temperature 27 degrees may be 0.17. The current cooling rate may be (27−27)/30=0. Thus, the difference value between the reference cooling rate 0.17 and the current cooling rate 0 may be 0.17. Since the difference value 0.17 is greater than the reference value 0.1, the air conditioner 1000 may identify the current environment (surrounding environment of the indoor unit 100) as an abnormal environment.

The various abnormal environment determination conditions described in FIG. 14 may be applied separately or combined according to the user's setting. Each of the reference values described in FIG. 14 may be different from each other and may vary depending on the initial temperature.

FIG. 15 is a diagram illustrating still another embodiment of detecting an abnormal environment according to temperature change of an indoor unit.

Referring to FIG. 15, a graph 1505 indicates temperature information obtained from a temperature sensor of the indoor unit 100. The graph 1505 may include a set temperature 1510, a measured temperature 1515. Since the basic description of the graph 1505 is the same as that of FIG. 13, a detailed description thereof will be omitted.

The set temperature 1510 may change at a specific time. FIG. 15 illustrates that set temperature is lowered (it is assumed that the set temperature changes from 25 degrees to 20 degrees in FIG. 15) before the threshold time elapses. In the graph 1505, the time when the turn-on command is received is t1, and the time when the set temperature is changed is t2. After receiving the turn-on command, the time when the threshold time (it is assumed 30 minutes in FIG. 15) elapses is t3, and after the set temperature is changed, the time when the threshold time elapses is t4.

The air conditioner 1000 may determine the abnormal environment based on the temperature change amount. The temperature change amount may refer to temperature difference changed in a time interval of first time and second time. The temperature change amount may vary according to how to determine the criteria of the first time and the second time.

When the set temperature is changed, the air conditioner 1000 may obtain the temperature change amount by four intervals.

A first interval 1520 may be from the time t1 when the turn-on command is received to the time t2 when the set temperature is changed. The temperature change according to the first period may mean a change until the set temperature is changed. The air conditioner 1000 may quickly determine the abnormal environment at the time of t2. If the time of the set temperature change is quick, accuracy of determination of the abnormal environment may be low.

The second interval 1525 may be from the time t1 to receive a turn-on command to the time t3 when the threshold time has elapsed after the turn-on command is received. Referring to FIG. 15, the example of lowering the set temperature than before is assumed, the temperature change of the second interval may have higher accuracy than the first interval. The reason why the accuracy of the second interval is high is that the first interval is less than the threshold time, but the second interval has elapsed for at least the threshold time.

The third interval 1530 may be the time from t1 when the turn-on command is received to t4 when the threshold time has elapsed after the set temperature is changed. The temperature change of the third interval may have higher accuracy than the first interval 1520 and the second interval 1525. If the time to determine the abnormal environment is long, the time when the air conditioner 1000 operates in abnormal environment may be long. Therefore, the air conditioner 1000 that determines the abnormal environment in the third interval 1530 may consume power amount a lot.

The fourth interval 1535 may be from t2 at the time when the set temperature is changed to t4 when the threshold time has elapsed after the set temperature is changed. The temperature change according to the fourth interval may mainly consider the changed set temperature. While the indoor temperature has significantly fell like FIG. 15, if the set temperature is changed, the temperature change amount may be measured to be small.

The air conditioner 1000 may decide various methods about measuring the temperature change according to which interval among the first to fourth intervals. According to an embodiment, the air conditioner 1000 may measure the temperature change amount based on the preset interval.

The air conditioner 1000 according to another embodiment may decide a calculation interval for obtaining temperature change amount based on the time when the set temperature is changed. A specific decision process will be illustrated through the graph 1550.

The air conditioner 1000 may measure the temperature change amount with fourth temperature 1535 if the time t2 when the set temperature is changed is less than a first reference value. If the set temperature changes fast, the importance of data before change of set temperature is less and thus, the air conditioner 1000 may measure the temperature change amount by using only the data after change of the set temperature.

The air conditioner 1000 may measure the temperature change amount with second interval 1525 if the time t2 when the set temperature is changed is greater than or equal to a first reference value. If the time of change of the set temperature elapses by a predetermined time, the indoor temperature may have already dropped and the air conditioner 1000 may ignore the time of change of the set temperature and may measure the temperature change amount based on the second interval 1525 to which the threshold time is reflected.

The air conditioner 1000 may measure the temperature change with the first interval 1520 if the time t2 when the set temperature is changed is greater than or equal to the second reference value.

The air conditioner 1000 according to still another embodiment may decide the calculation interval of obtaining the temperature change amount based on the difference value of the changed set temperature.

The air conditioner 1000 may measure the temperature change amount with the second interval 1525 if the difference value of the set temperature is less than a reference value. If the difference of the set temperature is small, change of the set temperature does not apply significantly, and the air conditioner 1000 may measure the temperature change amount based on the second interval 1525.

The air conditioner 1000 may measure the temperature change amount with the fourth interval 1535 if the difference value of the set temperature is greater than or equal to a reference value. If the difference of the set temperature is large, cooling output may become different significantly, and the air conditioner 1000 may measure the air conditioner 1000 based on the fourth interval 1535.

FIG. 16 is a diagram illustrating still another embodiment of detecting an abnormal environment according to temperature change of an indoor unit.

Referring to FIG. 16, a graph 1605 displays temperature information obtained from the temperature sensor of the indoor unit 100. The graph 1605 may include set temperature 1610 and measured temperature 1615. A basic description about the graph 1605 is the same as FIG. 15 and thus will be omitted.

Set temperature 1610 may change at a specific time. FIG. 16 illustrates that the set temperature rises before the threshold time has passed (FIG. 16 assumes that the temperature has changed from 20 degrees to 25 degrees). In the graph 1605, the time when the turn-on command is received may be decided as t1 and the time when the set temperature is changed may be decided as t2. The time when the threshold time (30 minutes are assumed in FIG. 16) has elapsed after receiving the turn-on command may be decided to t3, and the time when the threshold time has elapsed after the set temperature is changed may be decided to t4.

If the set temperature is changed, the air conditioner 1000 may obtain the temperature change amount with four intervals. The description of the first interval 1620, second interval 1625, third interval 1630, and fourth interval 1635 is overlapped with FIG. 15 and will be omitted.

The air conditioner 1000 may decide the calculation interval for obtaining the temperature change amount based on the time of change of the set temperature. A specific deciding process will be illustrated through a graph 1650.

The air conditioner 1000 may measure the temperature change in the fourth interval 1635 if the time t2 in which the set temperature is changed is less than the first reference value. If the set temperature changes quickly, importance of data before change of the set temperature is less, the air conditioner 1000 may measure the temperature change using only data after the set temperature is changed.

The air conditioner 1000 may measure the amount of change in the temperature of the air conditioner 1000 in the first interval 1620 if the time t2 in which the set temperature is changed is equal to or greater than the first reference value. If a predetermined time has elapsed from the time of change of the set temperature, the indoor temperature may have already dropped, so the air conditioner 1000 may ignore the time of set temperature change and may measure the temperature change amount based on the first interval 1625 reflecting the threshold time.

In FIG. 15, an operation of determining three calculation intervals according to a time t2 in which the set temperature is changed using a first reference value and a second reference value is described. However, unlike FIG. 15, it is assumed in FIG. 16 that the set temperature is increased. When the set temperature is increased, the difference between the initial indoor temperature and the set temperature is reduced. Therefore, the determination accuracy for the abnormal environment may be deteriorated. When the set change temperature is increased, the indoor unit 100 may not consider the second interval 1625 to increase accuracy.

Referring to FIGS. 15 and 16, the air conditioner 1000 may determine the calculation criteria of the temperature change based on the change in the set temperature (the change direction of the set temperature, the difference value of the change in the set temperature). The air conditioner 1000 may decide the calculation interval based on the graph 1550 when the set temperature is lowered, and may decide the calculation interval based on the graph 1650 when the set temperature is increased.

Figure 17:
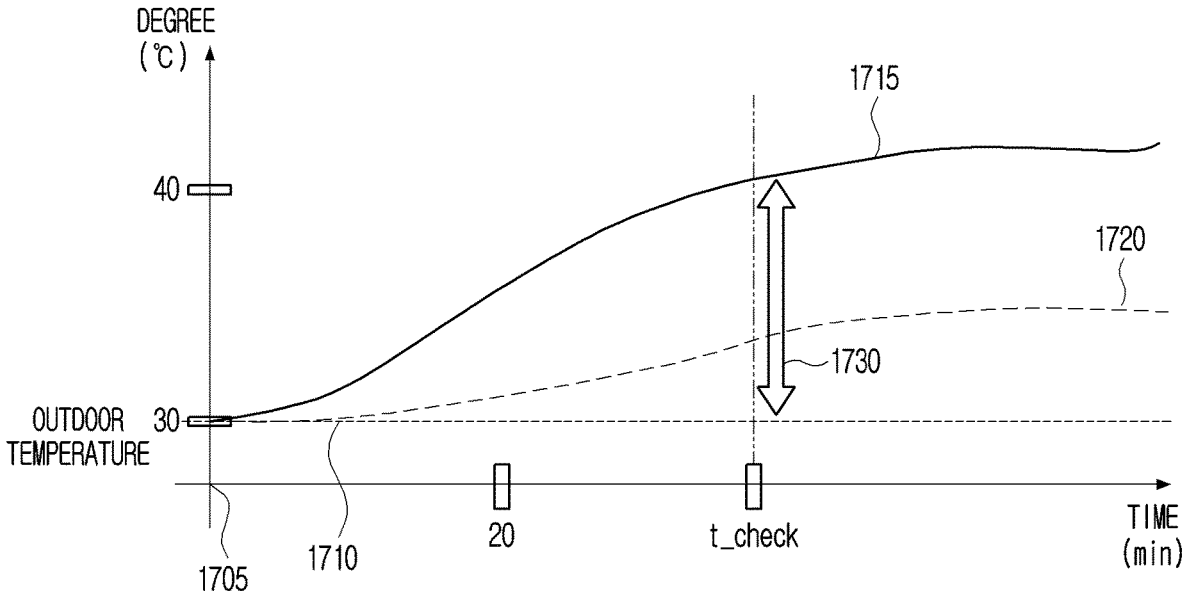
FIG. 17 is a diagram illustrating an embodiment of detecting an abnormal environment according to temperature change of an outdoor unit.

FIG. 17 is a diagram illustrating an embodiment of detecting an abnormal environment according to temperature change of an outdoor unit.

Referring to FIG. 17, the graph 1705 displays temperature information obtained from the temperature sensor of the outdoor unit 200. The x-axis of the graph 1705 is time, the unit is a minute, the y-axis is temperature, and the unit may be a centigrade. Here, the "t_check" may be the time at which threshold time has passed from the time when the turn-on command has been received (hereinafter, referred to as the detection time).

The graph 1705 may include an initial temperature 1710, a measured temperature 1715, and an expected temperature 1720. The initial temperature 1710 may refer to the temperature obtained by the outdoor unit temperature sensor at the time when a turn-on command is received or a control command for the temperature measurement from the air conditioner 1000 is received. The measured temperature 1715 may mean the temperature obtained by the outdoor unit temperature sensor according to each time. The expected temperature 1720 may be the previous temperature data of the air conditioner 1000 that changes over time. The expected temperature 1320 may mean outdoor temperature data of the air conditioner 1000 operated in a normal environment.

The air conditioner 1000 may determine whether the ambient environment of the outdoor unit 200 is abnormal after threshold time (hereinafter, abnormal environment determination).

The air conditioner 1000 may determine an abnormal environment of the air conditioner 1000 based on the initial temperature and the detection time temperature. If the difference value between the initial temperature and the detection time temperature is equal to or greater than the reference value, the air conditioner 1000 may determine that the current environment is an abnormal environment. For example, it is assumed that the reference value is 4. In FIG. 17, the initial temperature is 30 degrees and the detection time temperature is 40 degrees, and thus the difference value (10 degrees) is greater than the reference value (4 degrees). Accordingly, the air conditioner 1000 may identify the current environment (ambient environment of the outdoor unit 200) as an abnormal environment.

The air conditioner 1000 may determine that the current environment is an abnormal environment when the difference value between the expected temperature and the detection time is equal to or greater than a reference value. The expected temperature may mean outdoor temperature data of the air conditioner 1000 operating in a normal environment. It is assumed that the detection time temperature in the normal environment is stored in the memory as 33°, and it is assumed that the reference value is 5 degrees. Referring to FIG. 17, the expected temperature is 33 degrees and the detection time temperature is 40 degrees, and thus the difference value (7 degrees) is greater than the reference value (5 degrees). Accordingly, the air conditioner 1000 may identify the current environment (ambient environment of the outdoor unit 200) as an abnormal environment.

The air conditioner 1000 may determine that the current environment is an abnormal environment when the difference value between the outdoor unit reference temperature and the detection time temperature is equal to or greater than a reference value. Referring to table 1205 of FIG. 12, when the initial temperature (first temperature) is 30 degrees, the outdoor reference temperature is 34 degrees. Assume that the reference value is 5 degrees. Referring to FIG. 17, since the outdoor unit reference temperature is 34 degrees and the detection point temperature is 40 degrees, the difference value (6 degree) is greater than the reference value (5 degree). Accordingly, the air conditioner 1000 may identify the current environment (ambient environment of the outdoor unit 200) as an abnormal environment. Since the outdoor unit reference temperature is the data obtained by performing the cooling operation of the preset data or the air conditioner 1000, if the outdoor unit reference temperature is obtained by performing the cooling operation, the expected temperature and the outdoor reference temperature may be the same value.

The various abnormal environment determination conditions described in FIG. 17 may be applied separately or combined according to the user's setting. Each of the reference values described in FIG. 17 may be different from each other and may vary depending on the initial temperature.

Figure 18:
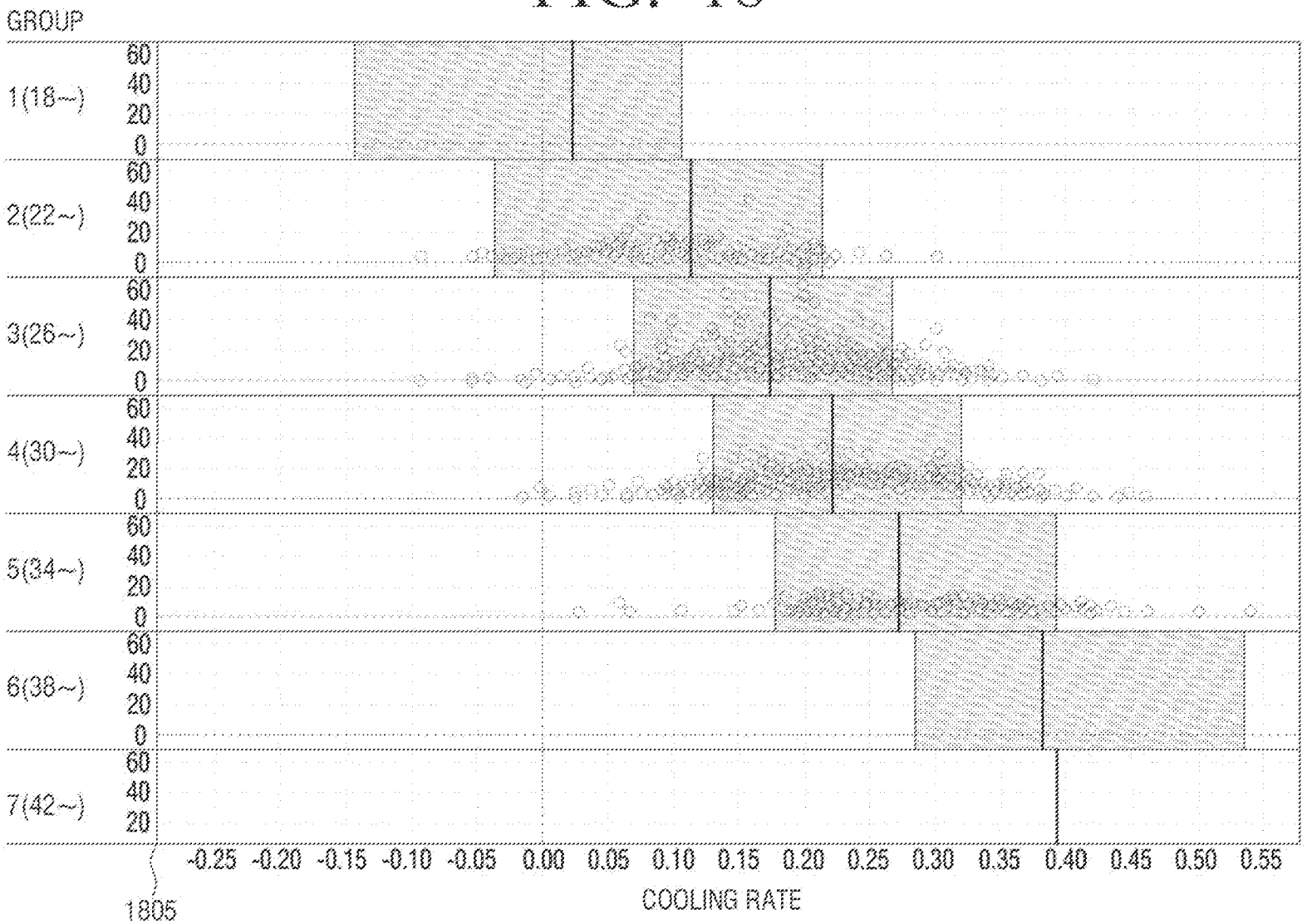
FIG. 18 is a diagram illustrating distribution of cooling rate associated with indoor temperature.

FIG. 18 is a diagram illustrating distribution of cooling rate associated with indoor temperature.

Referring to FIG. 18, a graph 1805 represents the distribution of the cooling rate according to the initial temperature using sample data (or test data). The initial temperature was divided into seven groups according to a predetermined interval. The cooling rate may be obtained based on a difference between the initial temperature and the temperature at which the threshold time has elapsed.

Referring to a graph 1805, the higher the initial temperature, the higher the average cooling rate. The temperature is generally set between 20 and 24 degrees and the set temperature after the threshold time in the normal environment may be between 20 degrees and 24 degrees. Therefore, the higher the initial temperature, the higher the cooling rate.

The air conditioner 1000 may differently set the reference cooling rate according to the initial temperature, considering that the cooling rate varies according to the initial temperature. The detailed description of the reference cooling rate is illustrated in FIG. 11, and thus detailed description thereof will be omitted.

Figure 19:
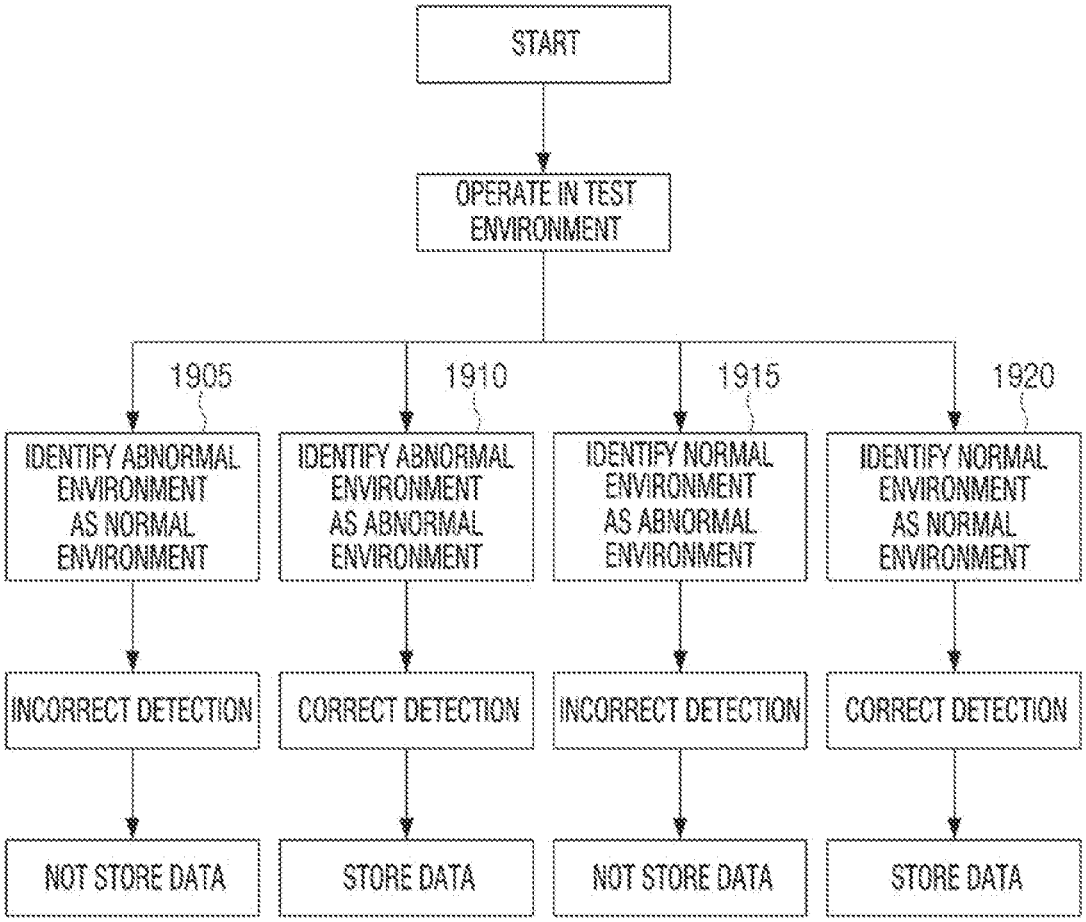
FIG. 19 is a diagram illustrating an operation of processing test data.

FIG. 19 is a diagram illustrating an operation of processing test data.

Referring to FIG. 19, the air conditioner 1000 may obtain sample data to obtain the reference cooling rate described in FIG. 11 or the outdoor unit reference temperature described in FIG. 12. In order to obtain sample data, various operations may be performed in the test environment. Specifically, various operations may mean obtaining data by operating the air conditioner 1000 in a state in which an abnormal environment or a normal environment is set.

There may be four situations. First, though the environment is abnormal, the air conditioner 1000 may identify the environment as normal environment (1905). In this example, since the air conditioner 1000 mistakenly detects the environment, the obtained data may not be stored in the memory.

Secondly, the environment is abnormal, and the air conditioner 1000 may identify the environment as abnormal environment (1910). In this example, the air conditioner 1000 correctly detected the environment, the obtained data may be stored in the memory.

Thirdly, the environment is normal, but the air conditioner 1000 may identify the environment as an abnormal environment (1915). In this example, the air conditioner 1000 mistakenly detected the environment, so the obtained data may not be stored in a memory.

Fourthly, the environment is normal, and the air conditioner 1000 may identify the environment as a normal environment (1920). In this example, the air conditioner 1000 detected the environment correctly, and the obtained data may be stored in the memory.

FIG. 20 is a diagram illustrating an operation of determining a threshold time corresponding to an indoor unit.

Referring to FIG. 20, it is assumed that 8,000 test operations were performed using 50,000 test devices to determine a threshold time. The test operation may refer to performing a turn-on command and a turn-off command so that one cooling operation is performed.

If test operations 80,000 times are performed using 50,000 test devices, various sample data may be obtained, and the test operation may be performed so that the abnormal environment is approximately between 9% and 11%.

The air conditioner 1000 may determine whether the ambient environment in which the indoor unit 100 is installed is an abnormal environment based on the detection time (the threshold time has elapsed after the turn-on command is received). Depending on when is to be decided as the detection time (threshold time), the number of identifying an abnormal environment may be different.

It is described the sample data if test operation by 80,000 times are performed using 50,000 test devices. The number of operations determined to be an abnormal environment in the sample data and the number of devices identifying the abnormal environment may be examined. If the detection time is 15 minutes, the number of devices identified as the abnormal environment and the number of devices identifying the abnormal environment are summarized in Table 2005. If the detection time is 30 minutes, the number of devices identified as the abnormal environment and the number of devices identifying the abnormal environment are summarized in Table 2010. If the detection time is 45 minutes, the number of the devices identified as the abnormal environment and the number of devices identifying the abnormal environment are summarized in Table 2015.

The number ratio of the operation determined to be the abnormal environment out of the entire sample data and the number ratio of the devices identifying the abnormal environment in the total sample data in table 2005 are analyzed and organized as shown in Table 2006. If the detection time is 15 minutes, the ratio of the number of operations determined to be an abnormal environment out of the entire sample data is 56%, and the ratio of the number of devices identifying the abnormal environment out of the entire sample data is 35%.

The number ratio of the operation determined to be the abnormal environment out of the entire sample data and the number ratio of the devices identifying the abnormal environment out of the entire sample data in table 2010 are analyzed and organized as shown in Table 2011. If the detection time is 30 minutes, the ratio of the number of operations determined to be an abnormal environment out of the entire sample data is 10%, and the ratio of the number of devices identifying the abnormal environment out of the entire sample data is 10%.

The number ratio of the operation determined to be the abnormal environment in the total sample data and the number ratio of the devices identified by the abnormal environment in the total sample data in table 2015 are analyzed and shown in table 2016. If the detection time is 45 minutes, the ratio of the number of operations determined to be an abnormal environment out of the entire sample data is 6%, and the ratio of the number of devices identifying the abnormal environment out of the entire sample data is 6%.

Since 9 to 11% was abnormal environment among 80,000 test operations, it may be desirable to determine the detection time in which the number ratio of the operation determined to be an abnormal environment out of the entire sample data and the number ratio of the devices identifying the abnormal environment out of the entire sample data are close to 10% as the final detection time. Referring to FIG. 20, the threshold time corresponding to the most preferred indoor unit 100 may be 30 minutes.

When the detection time is set to be too short, the temperature may be measured in a state that the cooling is not sufficient, and thus the accuracy of the determination may be deteriorated. If the detection time is set to be too long, the wasted power may be increased and the user may detect an abnormal environment and take action in advance, and thus, the reliability of the data may be lowered.

FIG. 21 is a diagram illustrating an operation of determining a threshold time corresponding to an outdoor unit.

The description of FIG. 21 overlaps with the description of FIG. 20 except measuring the outdoor unit data and a specific description will be omitted.

The sample data is obtained by performing 80,000 test operations using 50,000 test devices. The number of operations determined to be an abnormal environment in the sample data and the number of devices identifying the abnormal environment may be examined. If the detection time is 15 minutes, the number of devices identified as the abnormal environment and the number of devices identifying the abnormal environment are summarized in Table 2105. If the detection time is 30 minutes, the number of devices identified as the abnormal environment and the number of devices identifying the abnormal environment are summarized in Table 2110. If the detection time is 45 minutes, the number of the devices identified as the abnormal environment and the number of devices identifying the abnormal environment are summarized in Table 2115.

The number ratio of the operation determined to be the abnormal environment out of the entire sample data and the number ratio of the devices identifying the abnormal environment out of the entire sample data according to the table 2105 are analyzed and organized in Table 2106. If the detection time is 15 minutes, the ratio of the number of operations determined to be an abnormal environment out of the entire sample data is 21%, and the ratio of the number of devices identifying the abnormal environment out of the entire sample data is 8%.

The number ratio of the operation determined to be the abnormal environment out of the entire sample data and the number ratio of the devices identifying the abnormal environment out of the entire sample data in table 2110 are analyzed and organized according to table 2111. If the detection time is 30 minutes, the ratio of the number of operations determined to be an abnormal environment out of the entire sample data is 16%, and the ratio of the number of devices identifying the abnormal environment out of the entire sample data is 7%.

According to table 2115, the ratio of the number of operations determined as an abnormal environment out of the entire sample data and the ratio of the number of devices identifying the abnormal environment out of the entire sample data are analyzed and organized in table 2116. If the detection time is 45 minutes, the ratio of the number of operations determined as the abnormal environment out of the entire sample data is 11% and the ratio of the number of devices identifying the abnormal environment out of the entire sample data is 5%.

For example, since abnormal environment among the test operations of 80,000 times is 9% to 11%, it may be desirable to determine the detection time in which the number ratio of the operation determined to be an abnormal environment out of the entire sample data and the number ratio of the devices identifying the abnormal environment out of the entire sample are closet to 10% as the final detection time.

Unlike the data of the indoor unit 100 of FIG. 20, in the data of the outdoor unit 200 of FIG. 21, the ratio of the numbers of the operations determined as abnormal environment out of the entire sample and the ratio of the number of the device identifying the abnormal environment out of the entire sample data are not similar. Therefore, that the ratio of number of operations determined as abnormal environment is similar to 10% may be 45 minutes of detection time and that the ratio of number of devices identifying the abnormal environment is similar to 10% may be 15 minutes of detection time. Unlike the indoor unit 100, the incorrect detection of the outdoor unit 200 may cause overheating of the outdoor unit 200, possibly causing a problem in the durability of a product. Therefore, it is desirable to set the detection time of the outdoor unit 200 in a conservative manner as fast as possible. So, it is desirable to set the detection time to 15 minutes.

Figure 22:
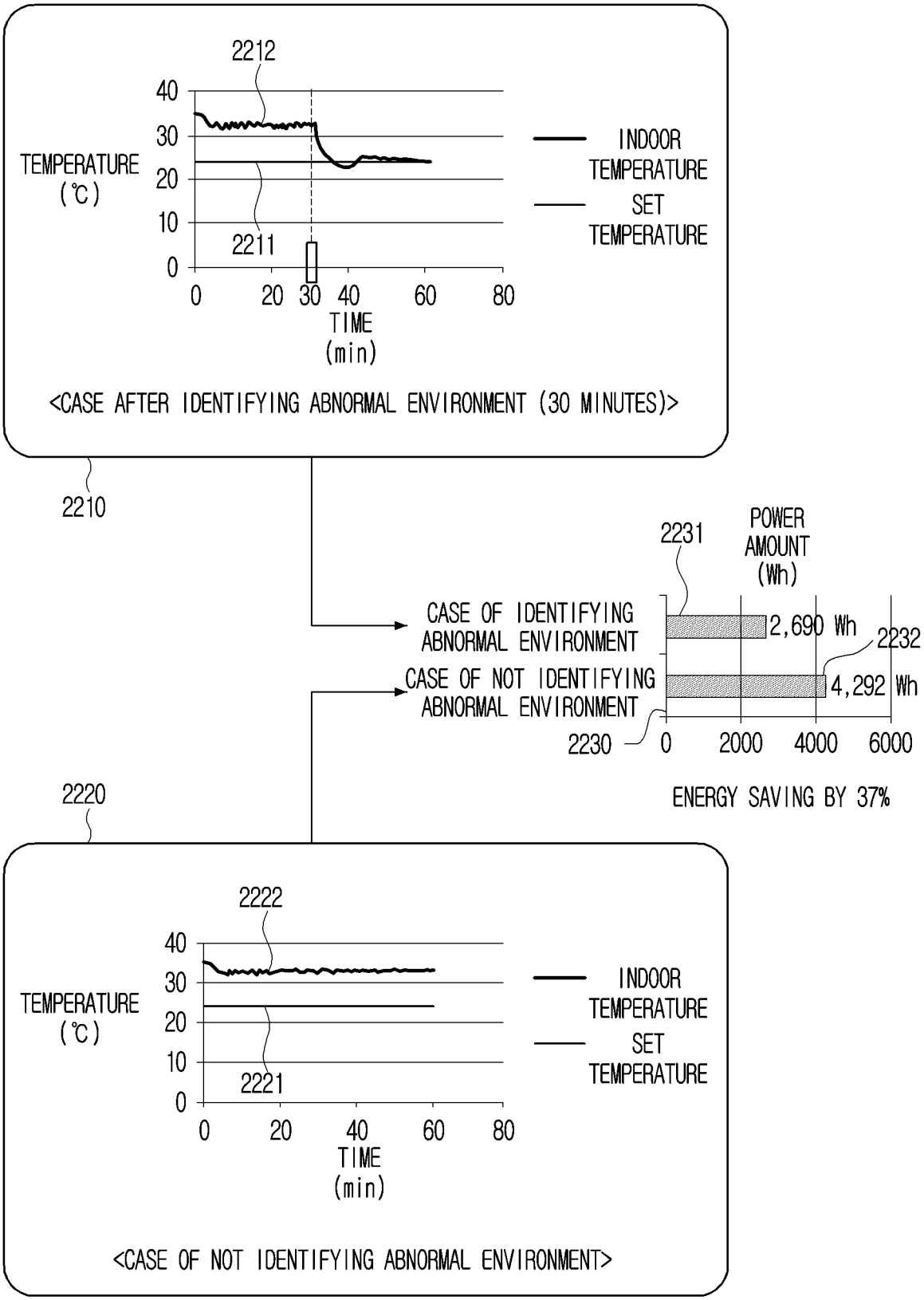
FIG. 22 is a diagram illustrating power amount of an indoor unit in an abnormal environment.

FIG. 22 is a diagram illustrating power amount of an indoor unit in an abnormal environment.

Referring to FIG. 22, when an abnormal environment is identified and an abnormal environment is not identified, the amount of power may be compared. A graph 2210 represents a temperature change when the air conditioner 1000 identifies an abnormal environment associated with the indoor unit 100. The graph 2210 may include a set temperature 2211 and an indoor temperature 2212. Referring to graph 2210, if the threshold time is 30 minutes, the indoor temperature does not fall due to the abnormal environment until the threshold time. However, when a threshold time (detection time) elapses, the air conditioner 1000 of the present application presents a solution for the abnormal environment to the user, so that the user may immediately perform a corresponding operation for the abnormal environment. After 30 minutes, the indoor temperature may be dropped according to the user's corresponding operation.

A graph 2220 may include a set temperature 2221 and an indoor temperature 2222. Unlike graph 2210, if no notification for an abnormal environment is provided to a user, an abnormal environment is likely to be maintained Thus, the indoor temperature 2222 may not drop to the set temperature and the cooling function is highly likely to continue.

A graph 2230 compares a power amount 2231 corresponding to the graph 2210 with a power amount 2232 corresponding to the graph 2220. When a notification for an abnormal environment is provided by identifying an abnormal environment, the amount of power may be 2690 Wh. If no notification for an abnormal environment is provided without identifying an abnormal environment, the amount of power may be 4292 Wh. The air conditioner 1000 according to an embodiment may reduce 37% of energy than if the notification for an abnormal environment is not provided FIG. 23 is a diagram illustrating power amount of an indoor unit in an abnormal environment.

Figure 23:
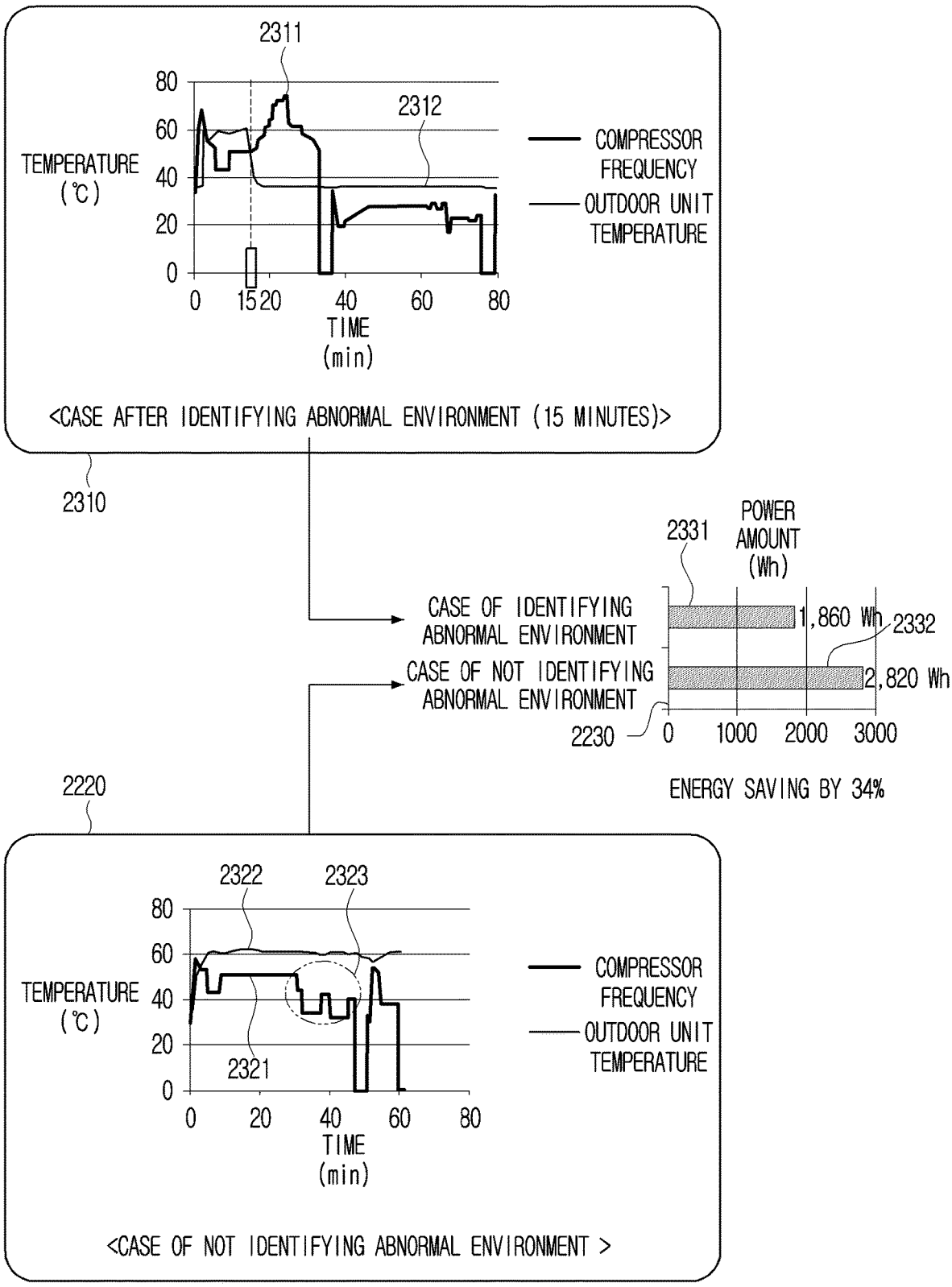
FIG. 23 is a diagram illustrating power amount of an indoor unit in an abnormal environment.

Referring to FIG. 23, when an abnormal environment is identified and an abnormal environment is not identified, the amount of power may be compared. A graph 2310 represents a temperature change when the air conditioner 1000 identifies an abnormal environment associated with the outdoor unit 200. The graph 2310 may include a compressor frequency 2311 and an outdoor temperature 2312. Referring to graph 2310, the outdoor unit temperature is maintained to be high until the threshold time (15 minutes). When a user performs a corresponding operation (opening a window of the air-conditioning plant room) at the threshold time, the outdoor unit temperature drops.

The graph 2320 indicates a change in temperature when the air conditioner 1000 does not identify the abnormal environment associated with the outdoor unit 200. The graph 2320 includes a compressor frequency 2321 and an outdoor temperature 2322. If the air conditioner 1000 does not identify the abnormal environment, the outdoor unit temperature is continuously maintained to be high. An interval where the compressor frequency falls 2323 reflects an operation to automatically control the compressor frequency in order to prevent malfunction of the outdoor unit 200. However, even if the compressor frequency is controlled, the outdoor unit temperature may not fall, and the temperature of the outdoor unit is continuously maintained to be high.

A graph 2330 compares a power amount 2331 corresponding to the graph 2310 with a power amount 2332 corresponding to the graph 2320. When a notification for an abnormal environment is provided by identifying an abnormal environment, the amount of power may be 1860 Wh. If no notification for an abnormal environment is provided without identifying an abnormal environment, the amount of power may be 2820 Wh. The air conditioner 1000 according to an embodiment may save 34% of energy than if the notification for the abnormal environment is not provided.

Figure 24:
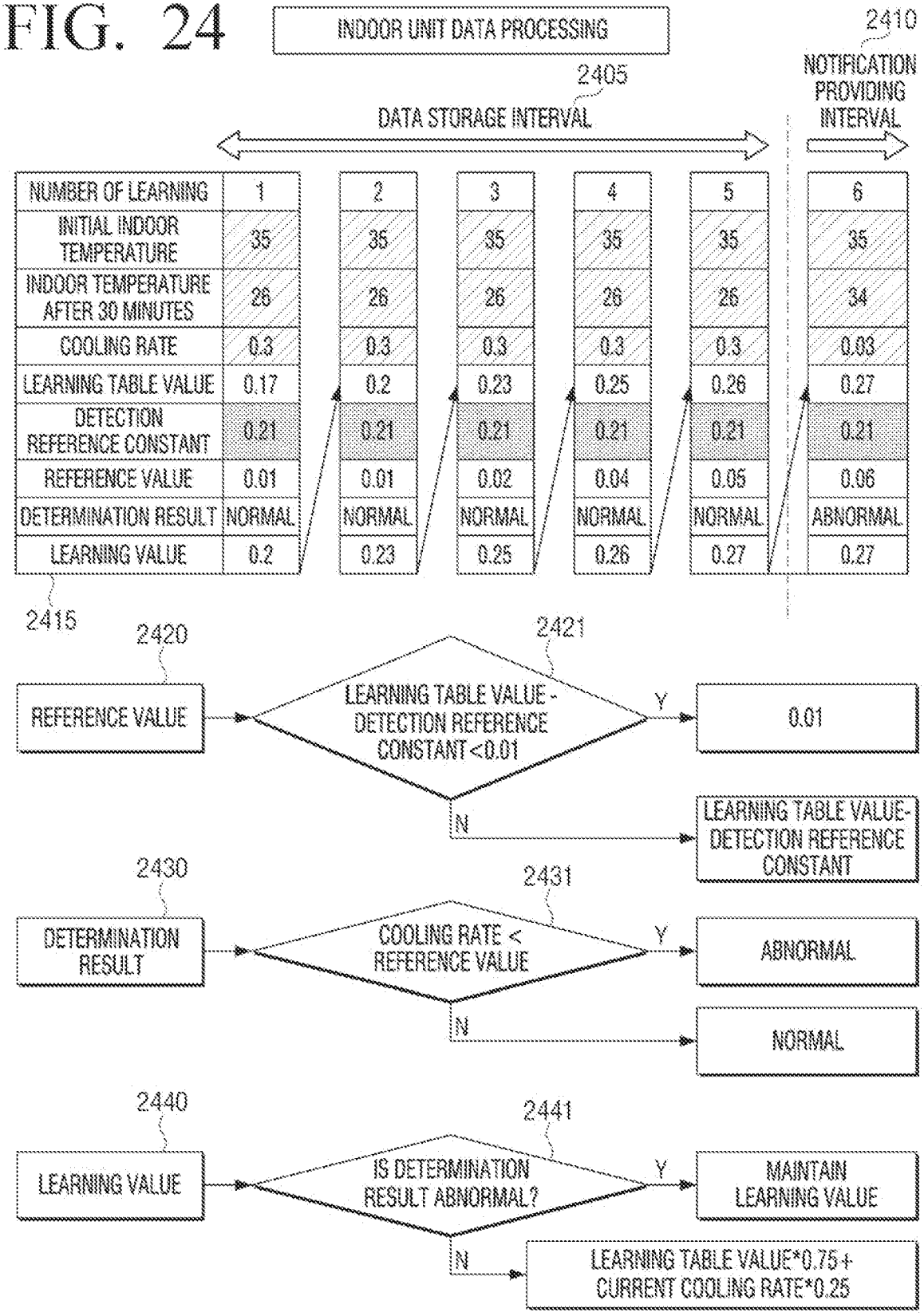
FIG. 24 is a diagram illustrating a calculation process to determine whether an environment in which an indoor unit is installed is abnormal.

FIG. 24 is a diagram illustrating a calculation process to determine whether an environment in which an indoor unit is installed is abnormal.

Referring to FIG. 24, a table 2415 may be a process of processing data related to the indoor unit 100. The number of learning may mean that the cooling operation is performed once. The number of learning times from one time to five times corresponds to an interval 2405 for storing data, and the air conditioner 1000 may not provide a notification to the abnormal environment until the number of learning times is stored five times. The air conditioner 1000 may determine an abnormal environment after 6 times of the number of learning, and provide a notification to the abnormal environment.

It is assumed that the initial indoor temperature is 35 degrees and the indoor temperature is equal to 26 degrees for the first time to the fifth time of learning after and the threshold time (30 minutes). The cooling rate may be (35−26)/30=0.3. The learning table value of the first time is may set a predetermined value to 0.17. The index reference constant 0.21 may also be a predetermined value.

A reference value 2420 may be obtained based on a value obtained by subtracting the index reference constant from the learning table value. The air conditioner 1000 may perform an operation 2421 of determining whether the value obtained by subtracting the index reference constant from the learning table value is less than 0.01 in order to determine the reference value 2420. If the value obtained by subtracting the index reference constant from the learning table value is less than 0.01, the reference value 2420 may be determined to be 0.01. If the value obtained by subtracting the index reference constant from the learning table value is 0.01 or more, the reference value 2420 may be determined to be a value obtained by subtracting the index reference constant from the learning table value.

A determination result 2430 may be determined based on the cooling rate and the reference value 2420. The air conditioner 1000 may perform an operation 2431 of determining whether the cooling rate is less than the reference value 2420 to obtain the determination result 2430. If the cooling rate is less than the reference value 2420, the air conditioner 1000 may identify that the ambient environment of the indoor unit 100 is abnormal. If the cooling rate is greater than or equal to the reference value 2420, the air conditioner 1000 may identify that the ambient environment of the indoor unit 100 is normal.

A learning value 2440 may be obtained based on a determination result 2430. The air conditioner 1000 may perform an operation 2441 of determining whether to maintain a previous learning value or to change to a new learning value according to the determination result 2430. If the determination result 2430 is abnormal, the air conditioner 1000 may maintain the previous learning value. If the determination result 2430 is normal, the air conditioner 1000 may store a learning table value (previous learning value)*0.75+current cooling rate*0.25 as a new learning value. The weight for the learning table value (previous learning value) may be set to 0.75 (75%) and the weight for the current cooling rate may be set to 0.25 (25%). The learning value 2440 may be used as a learning table value in the next operation.

The learning operation of the one time is calculated in table 2415. Since the learning table value is 0.17 and the index reference constant is 0.21, the value obtained by subtracting the index reference constant from the learning table value is −0.04. Since −0.04 is less than 0.01, the reference value is 0.01. Since the cooling rate 0.3 is greater than the reference value 0.01, the determination result is normal. Since the determination result is normal, the learning value may be 0.17*0.75+0.3*0.25=0.2 (rounding off in the second place of decimal point). The obtained learning value 0.2 may be used as a learning table value in two learning operations.

In a table 2415, the second to fifth learning operations may repeat the calculation process above.

The six learning operations are calculated in table 2415. By subtracting the index reference constant 0.21 from the learning table value 0.27, the reference value is 0.06, which is greater than 0.01, and the reference value is 0.06. In addition, since the room temperature is 34 degrees after 30 minutes in the six learning operations, the cooling rate becomes 0.03. Since the cooling rate 0.03 is smaller than the reference value 0.06, the air conditioner 1000 may identify that the ambient environment of the indoor unit 100 is abnormal. Since the determination result is abnormal, the learning value may maintain 0.27 of the previous learning value.

Figure 25:
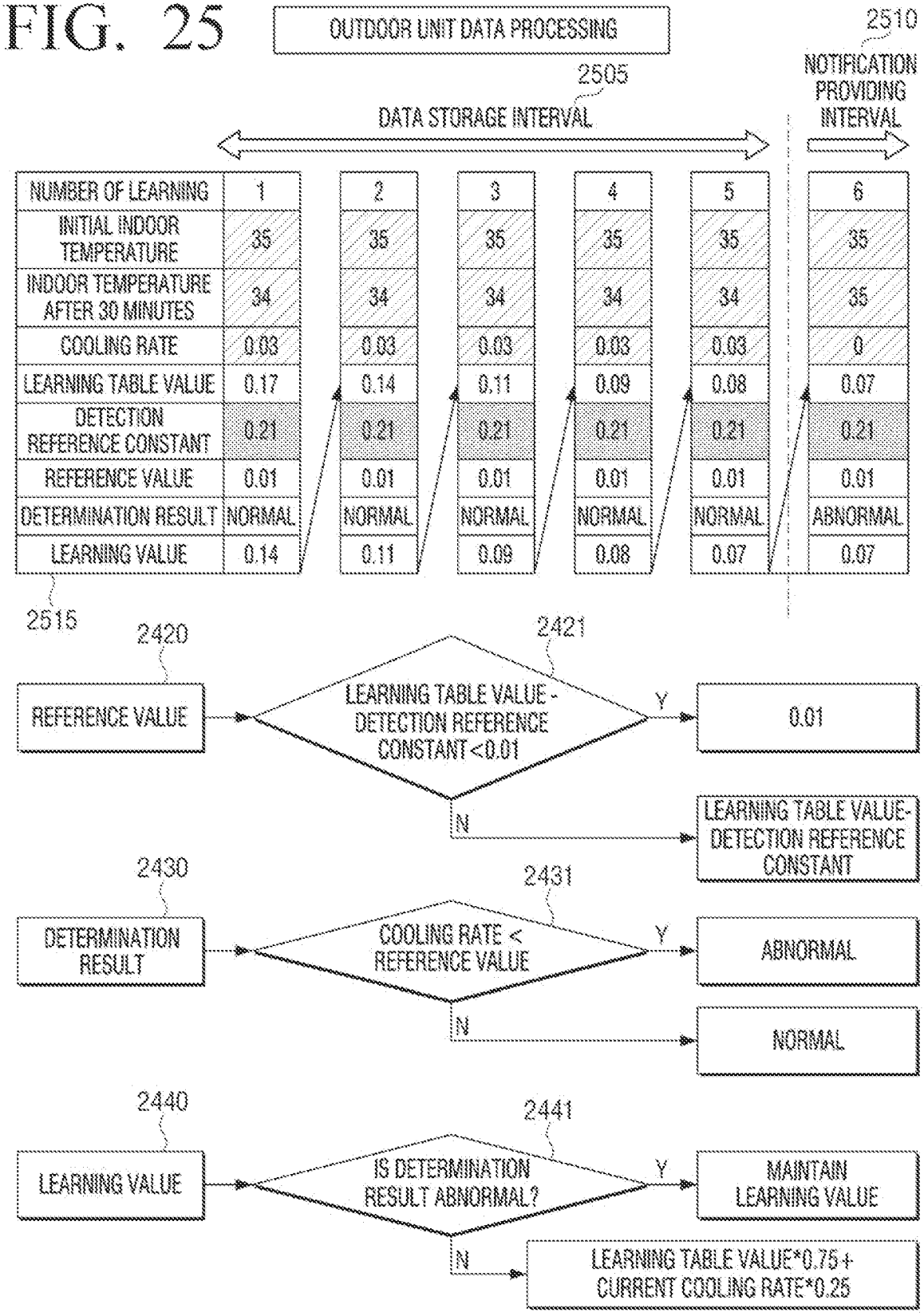
FIG. 25 is a diagram illustrating a calculation process to determine whether an environment in which an outdoor unit is installed is abnormal.

FIG. 25 is a diagram illustrating a calculation process to determine whether an environment in which an outdoor unit is installed is abnormal.

Referring to FIG. 25, a table 2515 may be a process of processing data related to the outdoor unit 200. If the number of learning is from one time to five times, it is an interval 2505 for storing data, and until the number of learning is stored by five times, the notification for the abnormal environment may not be provided. The air conditioner 1000 may determine an abnormal environment from the sixth time 2510 of number of learning, and may provide a notification to the abnormal environment.

A specific calculation operation related to a table 2515 is overlapped with the description of table 24, a detail will be omitted.

Figure 26:
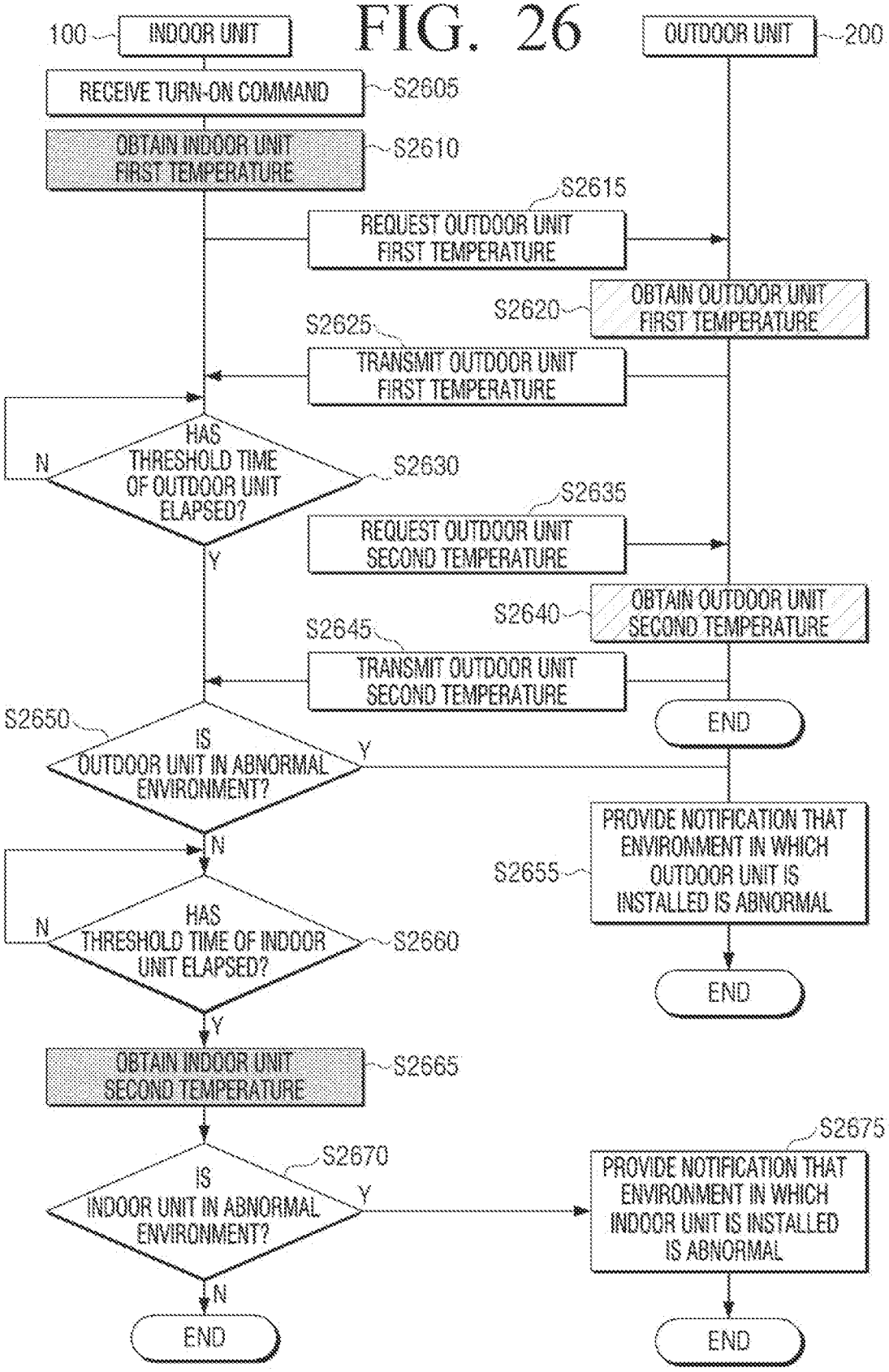
FIG. 26 is a flowchart for sequentially describing a control operation of an indoor unit and an outdoor unit according to an embodiment of the disclosure.

FIG. 26 is a flowchart for sequentially describing a control operation of an indoor unit and an outdoor unit according to an embodiment of the disclosure.

Referring to FIG. 26, the indoor unit 100 may receive a turn-on command in operation S2605. When a turn-on command is received, the indoor unit 100 may obtain the first temperature of the indoor unit from the indoor unit temperature sensor in operation S2610. When the turn-on command is received, the indoor unit 100 may transmit a control command requesting the first temperature of the outdoor unit to the outdoor unit 200 in operation S2615.

If the outdoor unit 200 receives a control command in operation S2615, the outdoor unit 200 may obtain the first temperature of the outdoor unit from the outdoor unit temperature sensor in operation S2620. The outdoor unit 200 may transmit the obtained first temperature of the outdoor unit to the indoor unit 100 in operation S2625.

When the indoor unit 100 receives the first temperature of the outdoor unit from the outdoor unit 200, the indoor unit 100 may determine whether the outdoor unit threshold time (e.g., 15 minutes) has elapsed in operation S2630. When the outdoor unit threshold time elapses, the indoor unit 100 may transmit a control command requesting the outdoor unit second temperature to the outdoor unit 200 in operation S2635.

When the outdoor unit 200 receives a control command of S2635, the outdoor unit 200 may obtain the outdoor unit second temperature from the outdoor unit temperature sensor in operation S2640. The outdoor unit 200 may transmit the obtained outdoor second temperature to the indoor unit 100 in operation S2645.

When the indoor unit 100 receives the outdoor unit second temperature from the outdoor unit 200, the indoor unit 100 may identify an abnormal environment of the outdoor unit 200 based on the first temperature of the outdoor unit and the second temperature of the outdoor unit in operation S2650. If it is determined that the ambient environment of the outdoor unit 200 is abnormal, the indoor unit 100 may provide a notification that the ambient environment in which the outdoor unit 200 is installed is abnormal in operation S2655. When an abnormal environment for the outdoor unit 200 is identified, the indoor unit 100 may terminate the processing operation without determining an abnormal environment for the indoor unit 100.

If it is determined in operation S2650 that the ambient environment of the outdoor unit 200 is normal, the indoor unit 100 may determine whether a threshold time (e.g., 30 minutes) of the indoor unit 100 has elapsed in operation S2660. If the threshold time of the indoor unit 100 elapses, the indoor unit 100 may obtain the indoor unit second temperature from the indoor unit temperature sensor in operation S2665. The indoor unit 100 may identify an abnormal environment of the indoor unit 100 based on a first temperature of the indoor unit and a second temperature of the indoor unit in operation S2670. If the ambient environment of the indoor unit 100 is identified to be abnormal, the indoor unit 100 may provide a notification that the ambient environment in which the indoor unit 100 is installed is abnormal in operation S2675. If the ambient environment of the indoor unit 100 is identified to be normal, the indoor unit 100 may terminate the determination operation.

In operation of FIG. 26, the threshold time of the outdoor unit 200 (e.g., 15 minutes) is different from the threshold time of the indoor unit (e.g., 30 minutes). The air conditioner 1000 may set the threshold time of the outdoor unit 200 to be smaller than the threshold time of the indoor unit 100.

All the operations of FIG. 26 may be implemented in which the operations described throughout the disclosure are additionally reflected.

Figure 27:
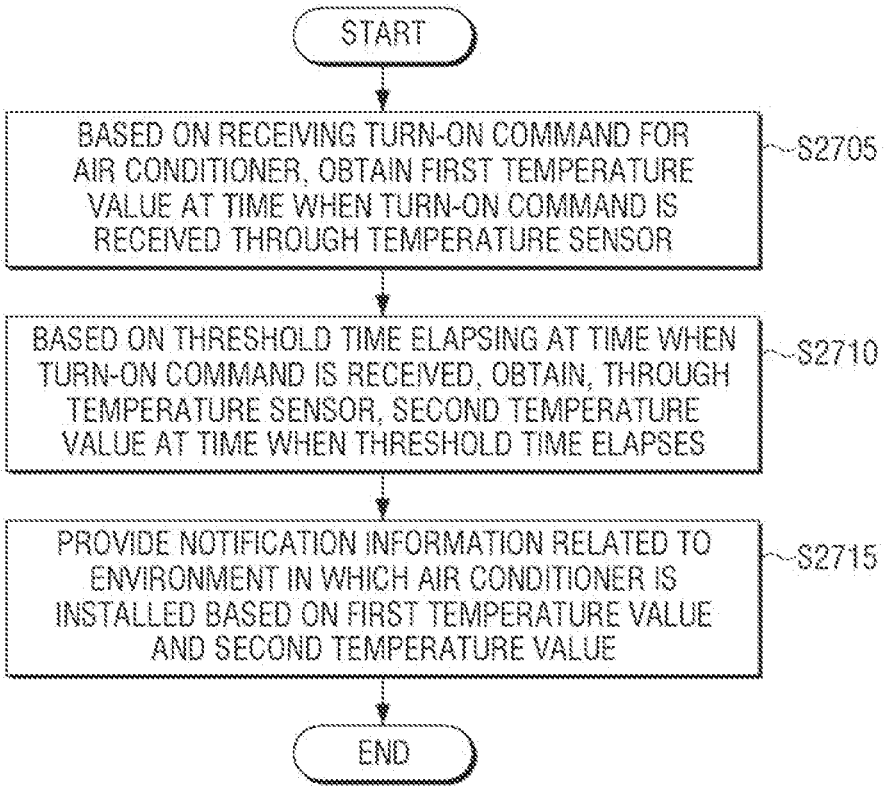
FIG. 27 is a flowchart to illustrating a method of controlling an air conditioner according to an embodiment of the disclosure.

FIG. 27 is a flowchart to illustrating a method of controlling an air conditioner according to an embodiment of the disclosure.

Referring to FIG. 27, a method of controlling the air conditioner 1000 according to an embodiment may include, based on receiving a turn-on command for the air conditioner, obtaining a first temperature value at a time when the turn-on command is received through a temperature sensor in operation S2705. The method may include, based on a threshold time elapsing at the time when the turn-on command is received, obtaining, through the temperature sensor, a second temperature value at a time when the threshold time elapses in operation S2710. The method may include providing notification information related to an environment in which the air conditioner 1000 is installed based on the first temperature value and the second temperature value in operation S2715.

The temperature sensor may be a temperature sensor included in the indoor unit 100, and the providing the notification information in operation S2715 may include, based on a difference between the first temperature value and a set temperature value at a time when the threshold time elapses being greater than or equal to a first reference value, and based on a difference between the first temperature value and the second temperature value being less than or equal to a second reference value, providing notification information related to an environment in which the indoor unit 100 is installed.

The method for controlling an air conditioner 1000 storing information about a reference cooling rate by initial temperatures may include identifying a current cooling speed corresponding to the threshold time based on the first temperature value and the second temperature value. The method may include identifying a reference cooling rate corresponding to the first temperature value based on the stored information. The providing the notification information in operation S2715 may include providing notification information related to an environment in which the indoor unit 100 is installed based on the current cooling rate, the reference cooling rate, and a set temperature value at a time when the threshold time elapses.

The temperature sensor may be a temperature sensor included in the outdoor unit 200, and the providing the notification information in operation S2715 may include, based on a difference between the first temperature value and the second temperature value at a time when the threshold time elapses being greater than or equal to a third reference value, providing notification information related to the environment in which the outdoor unit 200 is installed.

The method for controlling the air conditioner 1000 storing information about a reference temperature of the outdoor unit 200 by initial temperatures may include providing the notification information in operation S2715 which may include providing notification information related to an environment in which the outdoor unit 200 is installed based on the difference between the reference temperature of the outdoor unit 200 corresponding to the first temperature value and the second temperature value.

The providing the notification information in operation S2715 may include providing notification information related to the environment in which the air conditioner 1000 is installed based on the first temperature value, the second temperature value, and a frequency of a compressor.

The temperature sensor may include a first temperature sensor included in the indoor unit 100 and a second temperature sensor included in an outdoor unit 200, and the method for controlling the air conditioner 1000 may further include, based on identifying that the environment in which the outdoor unit 200 is installed does not satisfy a preset condition based on the first temperature value and the second temperature value obtained through the second temperature sensor, providing notification information related to the environment in which the outdoor unit 200 is installed and not provide notification information related to the environment in which the indoor unit 100 is installed.

A threshold time corresponding to the first temperature sensor may be longer than a threshold time corresponding to the second temperature sensor.

The providing the notification information in operation S2715 may include controlling a speaker to provide notification information related to the environment as voice.

The providing the notification information in operation S2715 may include controlling the communication interface to provide notification information related to the environment to an external device.

The control method of the air conditioner 1000 as FIG. 27 may be implemented by the air conditioner 1000 having the configuration of FIG. 2 or FIG. 3, or may be implemented on the air conditioner 1000 having other configurations.

The method according to various embodiments may be implemented as an application installable in a related-art air conditioner 1000.

The methods according to various embodiments may be implemented by only software upgrade or hardware upgrade of the related-art air conditioner 1000.

The various embodiments described above may be implemented by an embedded server provided in the air conditioner 1000, or an external server of at least one of the air conditioner 1000 and a display apparatus.

According to an embodiment, the various embodiments described above may be implemented as software including instructions stored in a machine-readable storage media which is readable by a machine (e.g., a computer). The device may include the electronic apparatus according to the disclosed embodiments, as a device which calls the stored instructions from the storage media and which is operable according to the called instructions. When the instructions are executed by a processor, the processor may perform functions corresponding to the instructions using other components or the functions may be performed under a control of the processor. The instructions may include code generated by a compiler or a code executed by an interpreter. The machine-readable storage media may be provided in a form of a non-transitory storage media. The 'non-transitory' storage media may not include a signal and is tangible, but does not distinguish whether data is stored semi-permanently or temporarily in the storage media.

According to an embodiment, a method according to one or more embodiments may be provided included a computer program product. The computer program product may be exchanged between a seller and a purchaser as a commodity. The computer program product may be distributed in the form of a machine-readable storage medium (e.g., a compact disc read only memory (CD-ROM)), or distributed online through an application store (e.g., PLAYSTORE™). In the case of online distribution, at least a portion of the computer program product (e.g., downloadable app) may be at least stored temporarily in a storage medium such as a server of a manufacturer, a server of an application store, or a memory of a relay server, or temporarily generated.

Further, each of the components (e.g., modules or programs) according to the various embodiments described above may be include a single entity or a plurality of entities, and some subcomponents of the above-mentioned subcomponents may be omitted or the other subcomponents may be further included to the various embodiments. Generally, or additionally, some components (e.g., modules or programs) may be integrated into a single entity to perform the same or similar functions performed by each respective component prior to integration. Operations performed by a module, a program, or other component, according to various embodiments, may be sequential, parallel, or both, executed iteratively or heuristically, or at least some operations may be performed in a different order, omitted, or other operations may be added.

While the disclosure has been illustrated and described with reference to various example embodiments, it will be understood that the various example embodiments are intended to be illustrative, not limiting. In other words, the disclosure is not limited to the specific embodiments described above. It will be further understood by those skilled in the art that various changes in form and detail may be made without departing from the true spirit and full scope of the disclosure, including the appended claims and their equivalents.

What is claimed is:

1. An air conditioner comprising:

a temperature sensor; and a processor configured to:

based on receiving a turn-on command for the air conditioner, obtain a first temperature value that is initially sensed through the temperature sensor when the turn-on command is received, based on a threshold time elapsing subsequent to the receiving of the turn-on command, obtain a second temperature value sensed through the temperature sensor, and provide notification information related to an environment in which the air conditioner is installed, based on a difference between the first temperature value and a set temperature value being greater than or equal to a first reference value, and based on a difference between the first temperature value and the second temperature value being less than or equal to a second reference value, wherein the set temperature value corresponds to a temperature for controlling output of a cooling function of the air conditioner, and the set temperature value is a temperature at a time when the threshold time has elapsed.

2. The air conditioner of claim 1, wherein the temperature sensor is included in an indoor unit, and wherein the notification information is related to an environment in which the indoor unit is installed.

3. The air conditioner of claim 1, further comprising:

a memory to store information about a reference cooling rate of an indoor unit by initial temperatures, wherein the first temperature value and the second temperature value are measured for the indoor unit, and the processor is configured to:

identify a current cooling rate corresponding to the threshold time based on the first temperature value and the second temperature value, identify a reference cooling rate corresponding to the first temperature value based on information stored in the memory, and provide notification information related to an environment in which the indoor unit is installed based on the current cooling rate, the reference cooling rate, and the set temperature value at the time when the threshold time has elapsed.

4. The air conditioner of claim 1, wherein the temperature sensor is included in an outdoor unit, and wherein the first temperature value and the second temperature value are measured for the outdoor unit, and the processor is configured to:

provide notification information related to the environment in which the outdoor unit is installed, based on a difference between the first temperature value and the second temperature value at the threshold time being greater than or equal to a third reference value.

5. The air conditioner of claim 1, further comprising:

a memory to store information about a reference temperature of an outdoor unit according to a range of initial temperatures, wherein the first temperature value and the second temperature value are measured for the outdoor unit, and the processor is configured to provide notification information related to an environment in which the outdoor unit is installed based on a difference between the reference temperature of the outdoor unit corresponding to the first temperature value and the second temperature value.

6. The air conditioner of claim 1, further comprising:

a compressor, wherein the processor is configured to provide the notification information related to the environment in which the air conditioner is installed based on the first temperature value, the second temperature value, and a frequency of the compressor.

7. The air conditioner of claim 1, wherein the temperature sensor includes:

a first temperature sensor included in an indoor unit, and a second temperature sensor is included in an outdoor unit, wherein the first temperature value and the second temperature value are measured for the outdoor unit, and wherein the processor is configured to:

provide notification information related to an environment in which the outdoor unit is installed, based on identifying that the environment in which the outdoor unit is installed does not satisfy a preset condition based on the first temperature value and the second temperature value obtained through the second temperature sensor, where no notification information related to the environment in which the indoor unit is installed is provided.

8. The air conditioner of claim 7, wherein a first threshold time corresponding to the first temperature sensor is longer than a second threshold time corresponding to the second temperature sensor.

9. The air conditioner of claim 1, further comprising:

a speaker, wherein the processor is configured to control the speaker to provide the notification information related to the environment as voice.

10. The air conditioner of claim 1, further comprising:

a communication interface, wherein the processor is configured to control the communication interface to provide the notification information related to the environment to an external device.

11. A method of controlling an air conditioner including a temperature sensor, the method comprising:

based on receiving a turn-on command for the air conditioner, obtaining a first temperature value that is initially sensed through the temperature sensor when the turn-on command is received;

based on a threshold time elapsing subsequent to the receiving of the turn-on command, obtaining a second temperature value sensed through the temperature sensor; and providing notification information related to an environment in which the air conditioner is installed, based on a difference between the first temperature value and a set temperature value being greater than or equal to a first reference value, and based on a difference between the first temperature value and the second temperature value being less than or equal to a second reference value, wherein the set temperature value corresponds to a temperature for controlling output of a cooling function of the air conditioner, and the set temperature value is a temperature at a time when the threshold time has elapsed.

12. The method of claim 11, wherein the temperature sensor is included in an indoor unit, and wherein the notification information is related to an environment in which the indoor unit is installed.

13. The method of claim 11, wherein information about a reference cooling rate of an indoor unit by initial temperatures is stored, the first temperature value and the second temperature value are measured for the indoor unit, and the method further comprises:

identifying a current cooling rate corresponding to the threshold time based on the first temperature value and the second temperature value; and identifying a reference cooling rate corresponding to the first temperature value based on the stored information, wherein the providing the notification information comprises providing notification information related to an environment in which the indoor unit is installed based on the current cooling rate, the reference cooling rate, and the set temperature value at the time when the threshold time has elapsed.

14. The method of claim 11, wherein the temperature sensor is included in an outdoor unit, the first temperature value and the second temperature value are measured for the outdoor unit, and wherein the providing the notification information comprises:

providing notification information related to the environment in which the outdoor unit is installed, based on a difference between the first temperature value and the second temperature value at the threshold time being greater than or equal to a third reference value.

15. The method of claim 11, wherein information about a reference temperature of an outdoor unit according to a range of initial temperatures is stored, the first temperature value and the second temperature value are measured for the outdoor unit, and the method comprises:

providing the notification information which comprises:

providing notification information related to an environment in which the outdoor unit is installed based on a difference between the reference temperature of the outdoor unit corresponding to the first temperature value and the second temperature value.

* * * * *